US010066367B1

(12) United States Patent
Wang et al.

(10) Patent No.: US 10,066,367 B1
(45) Date of Patent: Sep. 4, 2018

(54) SYSTEM FOR DETERMINING AUTONOMOUS ADJUSTMENTS TO AN IMPLEMENT POSITION AND ANGLE

(71) Applicant: Robo Industries, Inc., Houston, TX (US)

(72) Inventors: Liang Wang, Houston, TX (US); Linli Zhang, Houston, TX (US)

(73) Assignee: Robo Industries, Inc., Houston, TX (US)

( * ) Notice: Subject to any disclaimer, the term of this patent is extended or adjusted under 35 U.S.C. 154(b) by 0 days.

(21) Appl. No.: 15/186,959

(22) Filed: Jun. 20, 2016

(51) Int. Cl.

| | |
|---|---|
| ***E02F 9/20*** | (2006.01) |
| ***E02F 9/26*** | (2006.01) |
| ***E02F 9/22*** | (2006.01) |
| *E02F 3/76* | (2006.01) |
| *E02F 3/64* | (2006.01) |
| *E02F 3/65* | (2006.01) |
| *E02F 3/84* | (2006.01) |

(52) U.S. Cl.
CPC ..... *E02F 9/2029* (2013.01); *E02F 9/2045* (2013.01); *E02F 9/2246* (2013.01); *E02F 9/262* (2013.01); *E02F 9/265* (2013.01); *E02F 9/268* (2013.01); *E02F 3/6409* (2013.01); *E02F 3/652* (2013.01); *E02F 3/7609* (2013.01); *E02F 3/7636* (2013.01); *E02F 3/844* (2013.01); *E02F 9/205* (2013.01)

(58) Field of Classification Search
None
See application file for complete search history.

(56) References Cited

U.S. PATENT DOCUMENTS

| | | | | |
|---|---|---|---|---|
| 2007/0219693 | A1* | 9/2007 | Stratton | E02F 3/844 701/50 |
| 2008/0127530 | A1* | 6/2008 | Kelly | E02F 3/847 37/403 |
| 2013/0158819 | A1* | 6/2013 | Callaway | E02F 3/845 701/50 |
| 2015/0198936 | A1* | 7/2015 | McGee | H04W 88/00 700/40 |

* cited by examiner

*Primary Examiner* — Mussa A Shaawat
*Assistant Examiner* — Michael V Kerrigan
(74) *Attorney, Agent, or Firm* — Lee & Hayes, PLLC

(57) ABSTRACT

A system configured to be mounted to a vehicle for adjusting a position of an implement during an autonomous operation being performed by the vehicle. For example, the vehicle may monitor a height, slope angle, and/or load of an implement during an operation and adjust one or more parameters associated with the implement to achieve a desired finishing profile.

20 Claims, 18 Drawing Sheets

SYSTEM FOR DETERMINING AUTONOMOUS ADJUSTMENTS TO AN IMPLEMENT POSITION AND ANGLE

BACKGROUND

The presence of autonomous vehicles in today's world is becoming more and more common. However, in the field of work vehicles the autonomous control of an implement or work tool or more than just a position and movement of a vehicle is required. Therefore, autonomous control of work vehicles of the implement or work tool deployed on the work vehicle is typically reserved for a finishing stage following the leveling of the terrain by an operator controlled vehicle.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
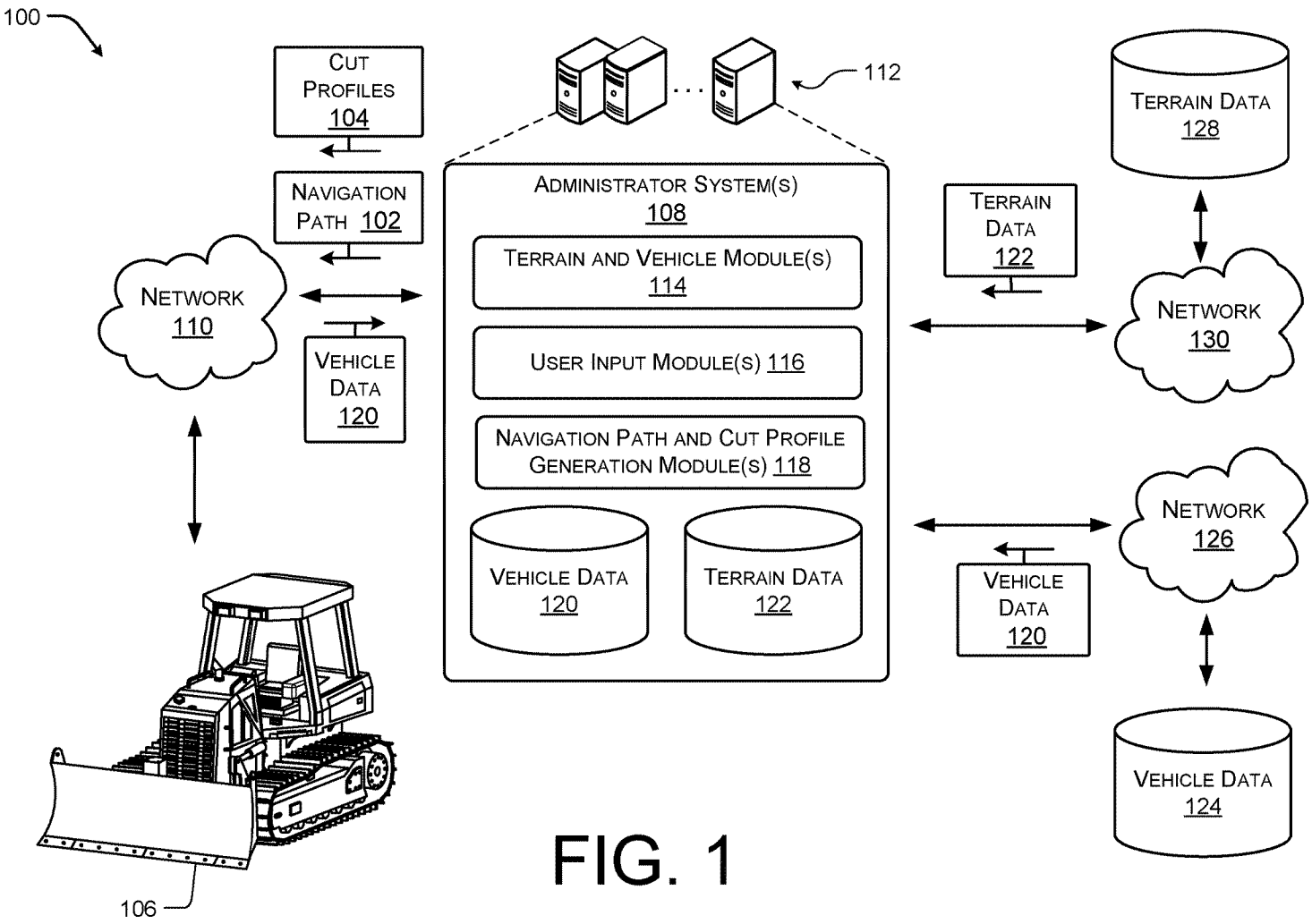
FIG. 1 illustrates an example system for generating and providing cut profiles to a vehicle configured for autonomous movement and implement control according to some implementations.

This disclosure includes techniques and implementations for controlling and adjusting a position of a blade or implement of a work vehicle (such as a bulldozer, motor grader, wheel tracker-scraper, etc.) in near-real time to autonomously perform a series of cutting profiles along a predefined navigation path. For example, the vehicle may be equipped with a control system having a control unit capable of receiving data from various sensors to monitor a position of the implement (e.g., height, angle, and tilt) with respect to the terrain, implement load, and a current cutting profile to adjust the implement in a manner to achieve the desired cut defined by a current cutting profile and/or to adjust the cutting profile (or series of cutting profiles) to achieve a desired finishing profile in an efficient and accurate manner.

In some cases the control system may include a control unit for processing data, and a communication interface communicatively coupled to the control unit. The communication interface may be configured to receive a navigation path and cutting profiles from an administrator system or remote control device. In some examples, the navigation path may be the trajectory and/or direction of movement of the vehicle over the surface of the terrain. In some cases, the navigation path may include multiple passes over the same terrain to allow the vehicle to perform multiple cuts. The cutting profiles may including instructions for controlling the blade or implement and include a depth, angle, and tilt of the implement associated with a particular pass over the terrain made along the navigation path.

The control unit may receive the navigation path and cutting profiles from the communication interface. The control unit may also receive the rational angles and the positions, orientation, and movement data from angle acquisition units and/or position units system, as described below. In some cases, the control unit may plot a course for the vehicle using the navigation path, the cutting profiles, the rotation angles, and the positions data as well as control the position of the implement based on the terrain, angle and tilt of the vehicle body, and the position, angle, and tilt of the implement at the implement point of interest (POI) in order to perform the cuts.

In some cases, an administrator or operator may access the administrator system or remote control to create the navigation path and the cutting profile. For example, the operator may outline terrain boundaries and a path over the given terrain, starting direction, the width of the path, maximum and minimum speed, maximum and minimum acceleration, maximum and minimum wear and tear, maximum and minimum power consumption, cutting angles, desired implement load, number of passes, finishing profile, among others.

In one particular example, when the remote operator desires to create a navigation path and cutting profiles associated with a job, the administrator system or remote control may establish a communication channel with the control unit on the vehicle to check the health of the vehicle and the status and accuracy of the navigation controls. For example, the health of the vehicle may include the power range (e.g., the minimum and maximum rotation per minute associated with an engine drive shaft), the coolant temperature, oil pressure, battery voltage, wheel or rack slip rate, etc. In some cases, the vehicle may be determined to be healthy when the various parameters are within one or more thresholds or ranges (e.g., the coolant temperature is between a maximum and minimum acceptable temperature).

In some cases, the administrator system may cause the vehicle to perform one or more operations or maneuvers while the control unit tracks and reports the operational functionality of the vehicle back to the administrator system. For instance, the control unit may determine the vehicle's minimum turn radius is larger than expected given the make and model of the vehicle and report the information related to the turn radius back to the administrator system for input into the creation of the navigation path. In some cases, the vehicle may determine attributes of the terrain while preforming the maneuvers which may be reported back to the administrator system. For example, the control unit may determine a hardness of the terrain by monitoring slip rate of the wheel and/or track, engine output power, and the implement load.

In addition to the information received from the vehicle, the operator may also provide inputs into the creation of the navigation path and cutting profiles via the administrator system. For example, the administrator system may present the operator with selectable options to define the navigation path and cutting profiles, to input the navigation parameters (e.g., width of the navigation path), select a type of navigation, type of activity or operation to be performed (e.g., in the case of a bulldozer, grading, leveling, sloping, etc.), operation preferences (e.g., time limits for the task, fuel usage limits, wear and tear limits, etc.), and finishing profile.

The administrator system may also access information known about the vehicle and/or the terrain a database or data store related to the vehicle. For example, the system may include one or more data repositories including each vehicles' make/model, capabilities (e.g., size, steering radius, engine capacity, fuel tank size, equipment, implement blade size, maximum speed, minimum speed, acceleration, towing capacity, etc.), maintenance history, among others to assist with generating the navigation path and the cutting profiles. The system may also access other data repositories or systems to collect information related to the terrain, such as topographical maps, surveying data, elevation, slope, and/or ground type (e.g., stone, gravel, clay, etc.). In some cases, the administrator system may allow the operator to select various information known about the vehicle, such as worn tracks, or about the terrain, such as exceptionally hard rock.

The administrator system may generate and send the navigation path and the cutting profiles to the control unit based at least in part on the data received from the control unit, the operator's inputs/selections, and the information accessed from various databases. In some cases, the administrator system may utilize fuzzy logic, machine learning, and/or various user generated tables to assist in generating the navigation path and the cutting profiles to achieve the desired operation within the desired operation preferences selected by the operator.

In one implementation, the control unit may determine the position, angles, and tilt of the vehicle and the implement using the data received from the positioning units and the angle acquisition units to cause near real time adjustment to the position of the implement with respect to the vehicle as the vehicle moves to maintain the desired cutting profile over uneven terrain. For example, the control unit may store or receive data associated with an implement height error, implement pitch angular rate and acceleration on the z axis and determine an implement height error change rate. Based on the height error change rate and the height error, the control unit may also determine an implement height correction command for the lift control system of the vehicle (e.g., is the implement positioned at a correct height with the respect to the terrain to achieve the desired cutting profile). At substantially the same time, the control unit may store or receive data associated a vehicle body pitch angular rate in the z axis, and determine an implement height disturbance introduced by the vehicle body pitch in the z axis. Based on the implement height disturbance and the vehicle body pitch angular rate, the control unit may also determine an implement height compensation command for the lift control system of the vehicle (e.g., does the vehicle body pitching with respect to the terrain affect the position of the implement with respect to the terrain). The control unit may combine the implement height correction command and the implement height compensation command to generate a lift control command that may be executed by one or more control devices of the lift frame associated with the implement.

In some cases, the control unit may also may store or receive data associated an implement slope angle error, implement tilting or slope angular rate and acceleration on the x axis and determine an implement slope angle error change rate. Based on the slope angle error change rate and the slope error, the control unit may determine an implement slope angle correction command for the implement control system of the vehicle (e.g., is the implement positioned at a correct slope and/or angle with the respect to the terrain to achieve the desired cutting profile). At substantially the same time, the control unit may store or receive data associated a vehicle body tilting angular rate in the x axis, and determine an implement slope angle disturbance introduced by the vehicle body tilting in the x axis. Based on the implement slope angle disturbance and the vehicle body tilting angular rate, the control unit may determine an implement slope angle compensation command for the tilting control system of the vehicle (e.g., does the vehicle body tilting with respect to the terrain affect the slope angle of the implement with respect to the terrain). The control unit may combine the implement slope angle correction command and the implement slope angle compensation command to generate an implement control command that may be executed by one or more control devices of the implement.

In some implementations, the control unit may adjust the cutting profiles and/or navigation path during operation based on the implement load, slip rate, vehicle velocity, etc. For example, if the terrain is harder or denser than expected by the administrator system during the navigation path and cutting profile generation process, the implement may experience a larger than expected load on the implement that results in poor performance of the vehicle and prolongs the time associated with completing the operation or job. In these cases, the control unit may be configured to receive data associated with the ground speed and wheel/track velocity, from various sensors and position systems mounted on the vehicle and the implement. The control unit may determine the slip rate of the wheel and/or track with respect to the terrain and when the slip rate is greater than a predefined slip rate threshold calculate new cutting profiles to improve the performance of the vehicle. In another example, the control unit may be configured to receive data associated with the power output torque and power transfer settings, from various sensors and position systems mounted on the vehicle and the implement. The control unit may determine the implement load and when the implement load is greater than a predefined load threshold calculate new cutting profiles to improve the performance of the vehicle.

As described above, the control unit may process data received from various sensors and position units mounted on the vehicle and the implement. For example, the control system may include one or more angle acquisition units, such as an inertial measurement unit (IMU), one or more positioning units (such as a Global Positioning System (GPS)), and propulsion monitoring units. The IMU(s) may be configured to collect data usable to determine rotation angles (pitch, roll, and yaw) associated with the implement point of interest (POI) along the bottom surface of the implement. The IMU sensor package may include accelerometers, gyroscopes, magnetometers, and/or barometric pressure sensors that may provide data usable to determine the angles, the angular rates, and the acceleration of the vehicle. In an example, data from multiple positioning units, such as two or more Global Navigation Satellite System (GNSS) sensors and receivers, may be utilized to determine some or all of the angles, the angular rates, and the acceleration. Additionally, the GPS system may be configured to decode a satellite signal in order to determine a position, orientation, and movement of the vehicle with respect to the surface of the Earth.

In one particular example, the angle acquisition units may include a first inertial measurement unit (IMU) configured to be mounted on the implement to determine the implement pitch, roll, and yaw. The first IMU may include one or more accelerometers, one or more gyroscopes, one or more magnetometers, and/or one or more pressure sensors, among others sensors. The first IMU sensor may include three accelerometers placed orthogonal to each other, three rate gyroscopes placed orthogonal to each other, three magnetometers placed orthogonal to each other, and a barometric pressure sensor. The angle acquisition units may also include a second IMU may be mounted on the vehicle body to determine the pitch, roll, and yaw of the vehicle body. In some cases, the second IMU may also include one or more accelerometers, one or more gyroscopes, one or more magnetometers, and/or one or more pressure sensors, among others sensors. In this example, the positioning unit may be mounted on the top of the vehicle body. The positioning unit may receive a signal from a satellite and decode the signal to determine a position of an antenna associated with the angle acquisition units in a global coordinate system.

In another particular example, a first IMU may again be mounted on the implement to provide the implement pitch, roll, and yaw angles. However, in this implementation, two positioning unit mounted on the top of the vehicle body. Each of the two positioning unit may be placed along the longitudinal axis of the vehicle body and/or along the lateral axis of the vehicle body. In both arrangements, a fixed distance between two positioning unit may be determined or measured during installation to assist with determining the vehicle body global position. A second IMU may be mounted on the vehicle body, as described above. In this implementation, the control unit may receive pitch, roll, and yaw angles from the second IMU and calculate the vehicle body pitch, roll, and yaw angles based on the pitch, roll, and yaw angles received form the second IMU, the two global position coordinates of the positioning unit, and the fixed distance between the two positioning units measured during installation. For example, the control unit may differentiate the two global position coordinates measured by the positioning unit to determine either the vehicle body pitch and yaw angles or the vehicle body roll and yaw angles depending on the arrangement of the two positioning unit. The control unit may obtain the missing angle (e.g., either the vehicle body roll or the vehicle body pitch) from the second IMU measurements. In some cases, by utilizing the two positioning units to estimate two of the three rational angles (e.g., the roll, pitch, and yaw) of the vehicle body a more accurate estimation of the implement POI with respect to the ground.

In another specific example, a first IMU may be disposed on the implement, as discussed above. Again, the control unit may receive the implement pitch, roll and yaw angle measurements from the first IMU. In this implementation, three positioning units may be mounted on the top of the vehicle body (e.g., a first positioning unit, a second positioning unit, and a third positioning unit). The first and second positioning units may be placed on the lateral axis of the vehicle body with a known or fixed spacing. The placement of the first positioning unit and the second positioning unit may result in a symmetrical distribution to the longitudinal axis of the vehicle body. The third positioning unit may be placed on the center part of the vehicle body. In this example, the control unit calculates the vehicle body pitch, roll, and yaw angles by using three global position coordinates measured by the positioning unit and the known distance between each positioning unit measured during installation. Using the various sensors configured above, the control unit may determine the position for the implement POI using the IMU and position unit data.

In some cases, a lift frame angle acquisition unit may be mounted on the lift frame in addition the IMUs and angle acquisition units described above. In some cases, the frame angle acquisition may be a gyroscope. In other cases, the frame angle acquisition unit may include gyroscopes, accelerometers, magnetometers, and/or pressure sensors. The frame angle acquisition unit may be mounted on the lift frame to assist in determining the pitch angle of the lift frame (or in the case of an IMU mounted on the lift frame the pitch, roll, and yaw of the lift frame).

The propulsion monitoring units may include a left propulsion monitoring unit and a right propulsion monitoring unit. The left propulsion monitoring unit may be coupled between a left drive motor and a left propulsion device (e.g., a track or wheel) to monitor an actual power transfer, direction, and/or velocity of the left side of the vehicle. Similarly, the right propulsion monitoring unit may be coupled between the right drive motor and the right propulsion device to monitor an actual power transfer, direction, and/or velocity of the right side of the vehicle.

FIG. 1 illustrates an example system 100 for providing navigation path 102 and cut profiles 104 to a vehicle 106 configured for autonomous movement and implement control according to some implementations. For example, the vehicle 106 may be equipped with a control unit to monitor and control the vehicle's 106 power delivery system, steering system, and implement controls (e.g., lift frame, tilt cylinders, pitch cylinders, etc.).

In the illustrated example, an administrator system 108 is in communication with a control unit (not shown) of the vehicle 106 via a network 110. In general, the administrator system 108 may allow an operator remote from the vehicle 106 to generate the navigation path 102 and cutting profiles 104 to allow the vehicle 106 to autonomously perform operations associated with a j ob. For example, the administrator system 108 may be implemented by one or more servers, such as servers 112. Additionally, the servers 112 may host any number of modules to receive input, collect data, and generate navigation paths 102 and cut profiles 104. In some cases, the modules may include a terrain and vehicle analysis module 114, a user input module 116, a navigation path and cut profile generation module 118, among others.

In some cases, the administrator system 108 may store the vehicle data 120 and the terrain data 122. However, in other examples, the vehicle data 120 may be stored in a remote database 124, such as a vehicle capabilities database maintained by the manufacturer of the vehicle 106, and the administrator system 108 may access the vehicle data 120 stored in the database via a network 126. In other cases, the vehicle 106 may send the vehicle data 120 to administrator system 108 in addition to or in lieu of the stored vehicle data 120. Similarly, the terrain data 122 may be stored in a remote database 128 and the administrator system 108 may access the terrain data 122 stored in the database via a network 130. In the current example, the networks 110, 126, and 130 are shown as different networks. However, in some instances, the networks 110, 126, and 130 may be the same network, such as the Internet.

The terrain and vehicle module 114 may cause the administrator system 108 to establish a communication channel with the vehicle 106, the remote database 124, or the remote database 128 to retrieve the vehicle data 120 and the terrain data 122. For instance, the terrain and vehicle module 114 may send diagnostic test instructions to the control unit on the vehicle 106 to engage the navigation controls and collect data associated with the functionally of the vehicle 106 and the current terrain.

The user input module 116 may allow the operator to provide inputs into the creation of the navigation path 102 or the cutting profiles 104. For example, the user input module 116 may present the operator with selectable options to define or draw the navigation path 102, to input the navigation parameters (e.g., width of the navigation path 102), select a type of navigation, type of activity or operation to be performed (e.g., in the case of a bulldozer, grading, leveling, sloping, etc.), operation preferences (e.g., time limits for the task, fuel usage limits, wear and tear limits, implement load limits, etc.), among others. In some cases, the user input module 116 may allow the operator to select or input various information known about the vehicle 106 or about the terrain and useful for generating the navigation path 102 and the cutting profiles 104.

The navigation path and cutting profile generation module 118 is configured to generate the navigation path 102 and the cut profiles 104 based at least in part on the user inputs, the vehicle data 120 and the terrain data 122. For example, the navigation path and cutting profile generation module 118 may modify a navigation path 102 defined or outlined by the operator to increase a turning radius to, thereby, reduce the potential for decoupling a track from the wheel. In another example, the navigation path and cut profile generation module 118 may generate a series of cut profiles to achieve a desired finishing profile on the surface of the terrain.

In some examples, the navigation path and cutting profile generation module 118 may generate a series of navigation paths 102 that allow the vehicle 106 to make several passes over the same terrain to allow for multiple cuts based on multiple cut profiles to achieve the finishing profile. For example, the vehicle 106 may make several cuts based on multiple cutting profiles as described below with respect to FIG. 2.

Figure 2:
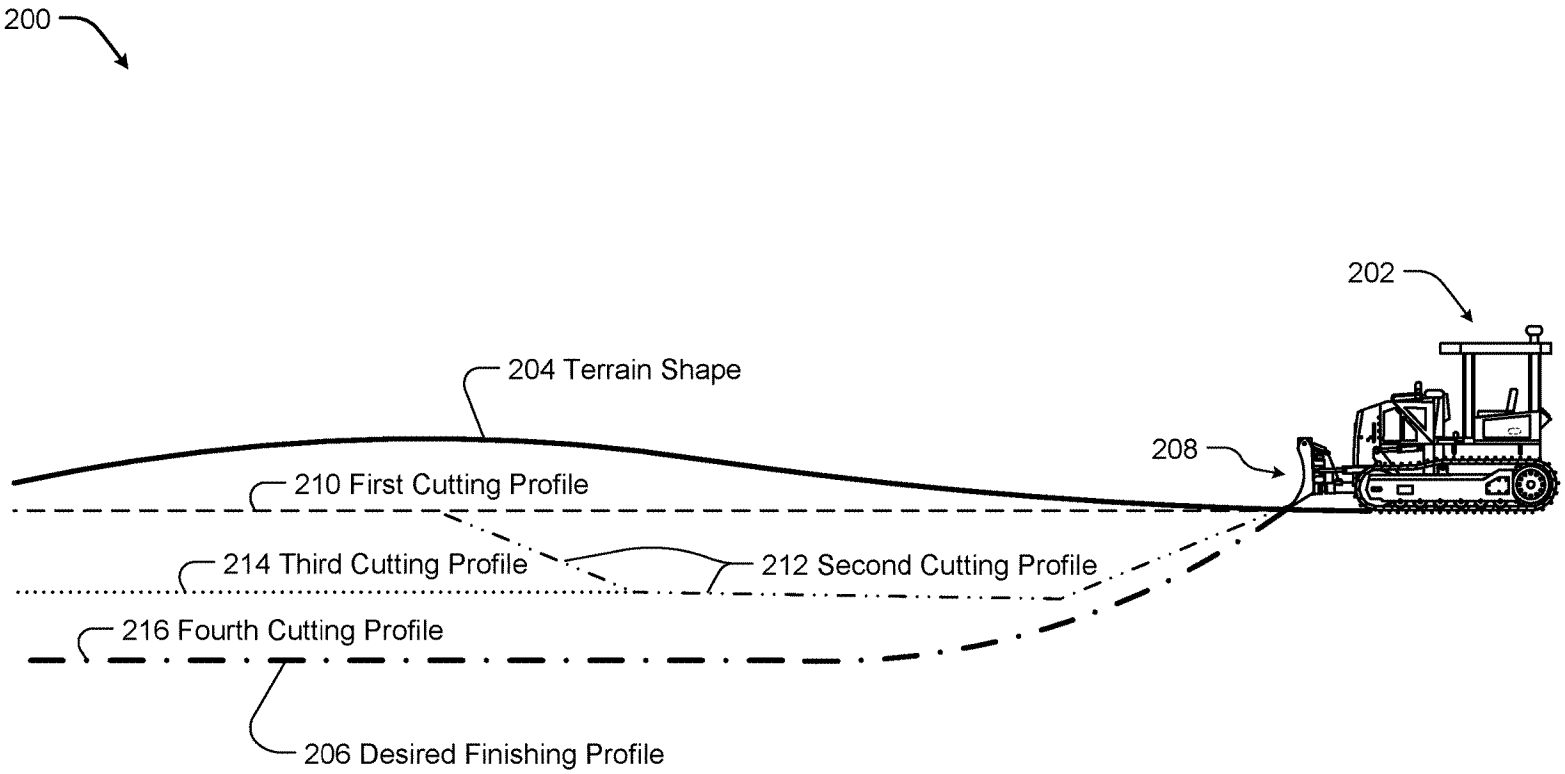
FIG. 2 is an example pictorial diagram showing a multiple cut profiles that may be selected to achieve a desired finishing profile according to some implementations.

FIG. 2 is example pictorial diagram 200 showing a multiple cut profiles that may be selected to achieve a desired finishing profile according to some implementations. For example, in the illustrated example, a vehicle 202 may be performing an operation to shape the terrain 204 in a manner to achieve the desired finishing profile 206 using the implement 208. Unfortunately, the vehicle 202 may be unable to move the amount of terrain 204 required to achieve the finishing profile 206 in one pass or via one cut. Therefore, the vehicle 202 may make multiple cuts, each cut removing a portion of the terrain 204 to achieve the finishing profile 206. For instance, in the illustrated example, the vehicle 202 may make four cuts, generally indicated by 210-216.

Prior to the vehicle 202 making a cut, the terrain 204 has the terrain shape shown by the solid line. An administrator system (not shown) may send a navigation path and the cutting profiles 210-216 to the vehicle 202 or a control unit (not shown) associated with the vehicle 202. The navigation path may include four passes over the terrain 204 to allow the vehicle 202 to make the four cuts defined by the cutting profiles 210-216.

During a first pass, the vehicle 202 using the implement 204 may make a straight cut according to the first cutting profile 210. Thus, on the first pass the vehicle 202 may remove a first portion of the terrain 204 in a manner to substantially level the ground. The vehicle 202 may return to make the second pass according to the second cutting profile 212. On the second pass, the vehicle 202 may remove a second portion of the terrain 204 located between the first cutting profile 210 and the second cutting profile 212. The vehicle 202 may return again to make the third pass according to the third cutting profile 214. On the third pass, the vehicle 202 may remove a third portion of the terrain 204 located between the first cutting profile 210 and the second cutting profile 214, as shown. Finally, the vehicle 202 may make the fourth pass according to the fourth cutting profile 216. On the fourth pass, the vehicle 202 may remove a fourth portion of the terrain 204 located between the second cutting profile 212, the third cutting profile 214, and the fourth cutting profile 216, as shown.

Once the fourth pass is complete, the vehicle 202 may have achieved the desired finishing profile 206. However, it should be understood that additional passes may be required to smooth or finalize the surface of the terrain 204 once the maj ority of the terrain 204 has been removed by the vehicle 202 during the first four passes. Additionally, the smoothing or finalizing of the surface of the terrain 204 as well as the first four passes may be performed by different vehicles or vehicles having different types of implements depending on the type of operation and the desired finishing profile 206.

In some examples, as the vehicle 202 is performing one or more of the cuts defend by the cutting profiles 210-216, the vehicle 202 may determine that one or more of the cutting profiles 210-216 may need to be redefined. For example, if the second cutting profile 212 results in a load on the implement 204 greater than a threshold amount, the vehicle 202 may experience difficulty in moving the load and may even become stuck. In this example, the control unit may receive data associated with the wheel or track slip rate, velocity and/or ground speed of the vehicle 202, and/or the load and/or resistance on the implement 204. The control unit may analyze the data and determine if the slip rate is above a slip threshold, the ground speed is below a speed threshold, and/or the load is above a load threshold, and in response to determining one of the thresholds has been meet or exceeded, adjusting the current cutting profile and the subsequent cutting profiles to more efficiently accomplish the desired finishing profile 206.

Figure 3:
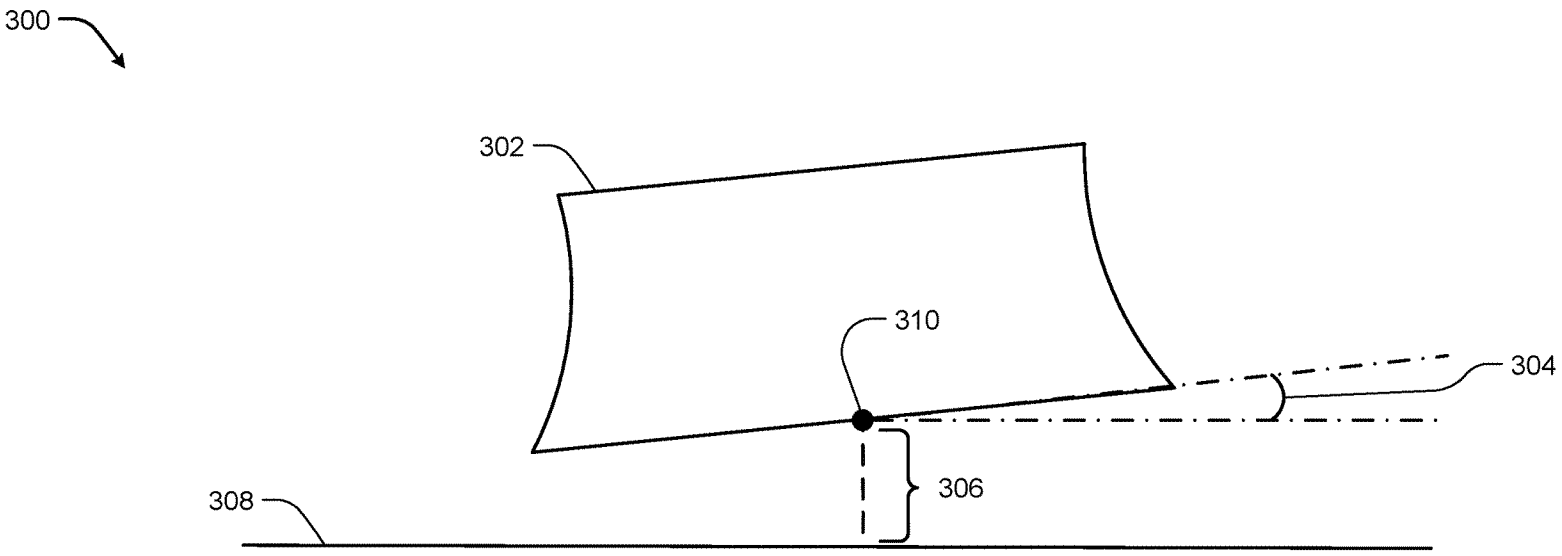
FIG. 3 is an example pictorial diagram showing an implement experiencing slope error and height error while performing a cut according to some implementations.

FIG. 3 is an example pictorial diagram showing an implement 302 experiencing slope error 304 and height error 306 while performing a cut according to some implementations. For instance, in the illustrated example, a vehicle may be performing a cut based on a current cutting profile that has a target slope and height, generally illustrated by line 308 (e.g., in this example, the cut may be a level or horizontal cut at the height indicated by the line 308). Thus, the current placement of the implement 302 with respect to the terrain would result in an angled cut at a level above the target slope and height 308.

A control unit associated with the vehicle may monitor a slope angle and height of the implement 302 with respect to the cut profile during operation. In particular, the control unit may monitor the slope angle and height of the implement 302 at an implement POI 310. In some cases, the control unit may determine the current slope angle and the current height of the implement POI 310 using data collected by various position units (e.g., GNSS receivers) and angle acquisition units (e.g., IMUs) mounted on, for example, the vehicle body, the vehicle lift frame, and/or the implement 302 as well as known offsets between particular locations on the vehicle, location of the position units on the vehicle, and/or the locations of the angle acquisition units on the vehicle measured during installation of the position units and the angle acquisition units, as described in more detail below.

Once the control unit obtains the height and slope angle of the implement 302, the control unit may determine the slope error 304 (e.g., the difference in the slope of the implement 302 with respect to the angle designated in the current cutting profile) and the height error 306 (e.g., the difference in the height of the implement 302 and the height designated in the current cutting profile). The control unit may generate one or more commands to the devices associated with controlling the position, tilt, and/or angle of the implement 302 (e.g., the lift frame control devices, the implement control devices, tilt cylinders, pitch cylinders, etc.) to adjust the position of the implement 302 with respect to the targeted slope angle and height 308. In some cases, the control unit may also adjust the parameters of the subsequent cutting profiles to correct for any issues resulting from the slope error 304 and/or the height error 306 on the current cutting profile.

Figure 4:
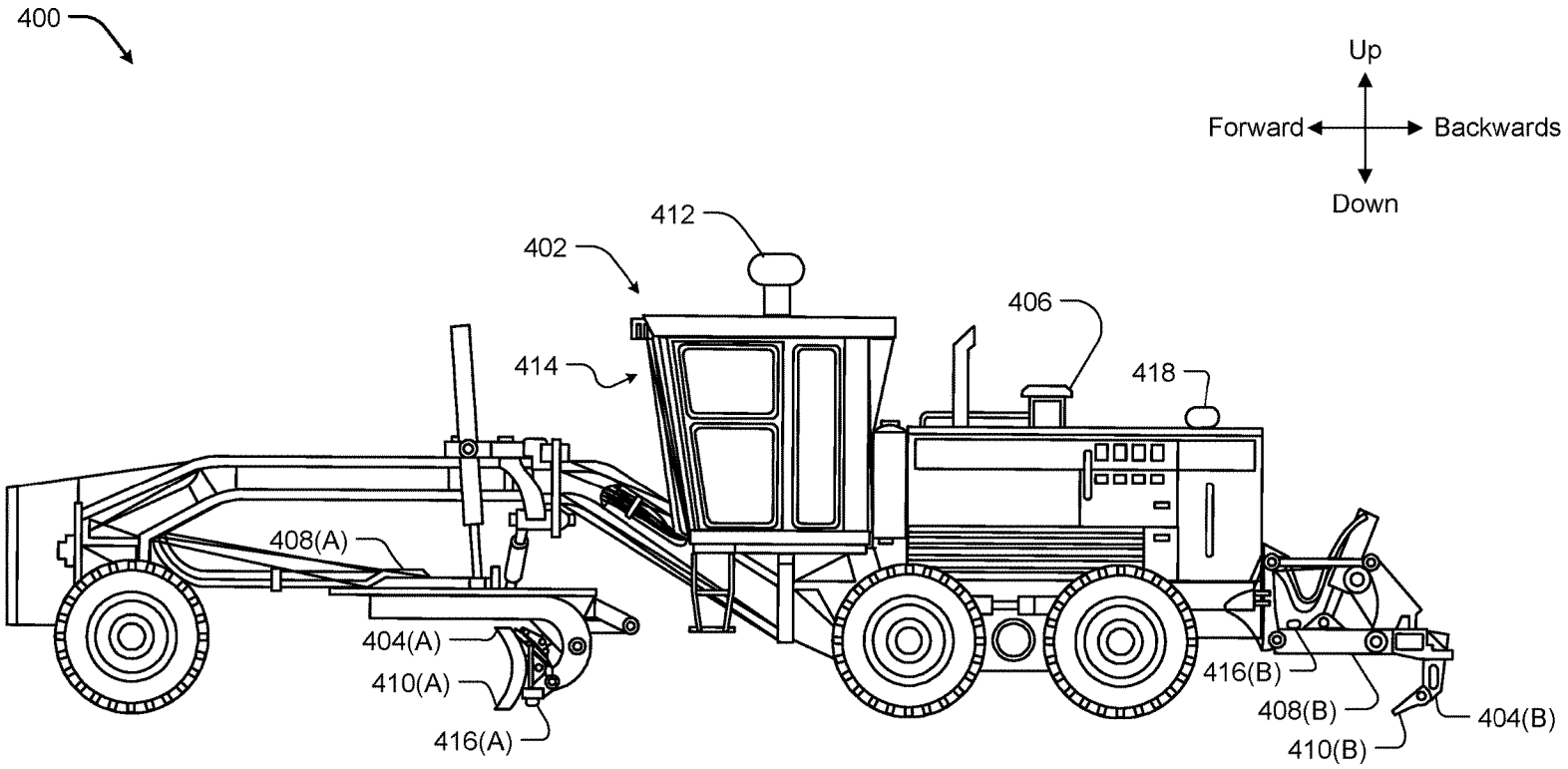
FIG. 4 is a side view of a sensor package system mounted on a vehicle for determining an implement point of interest according to some implementations.

FIG. 4 is a side view of a sensor package system 400 mounted on a vehicle 402 for determining an implement point of interest according to some implementations. In the current example, the vehicle 402 is a motor grader and includes two implement 404(A) and 404(B). Implement 404(A) is a blade that may be utilized to level or perform finishing cuts associated with a series of cutting profiles. Implement 404(B) is a ripper claw that may be used to loosen or perform initial passes over the terrain prior to a second vehicle, such as a bulldozer, performing other operations associated with a series of cutting profiles. Thus, in some cases, multiple vehicles may be utilized to perform a series of cutting profiles associated with an operation or job.

In this example, the vehicle 402 does not include pitch cylinders for controlling the pitch of the implements 404(A) and 404(B) independent of the pitch of the corresponding lift frame 408(A) or 408(B). As discussed above, in the current example, the vehicle 402 is a motor grader but it should be understood that the sensor package system 400 may be applied to any vehicle including an implement 404(A) or 404(B), such as a bulldozer, wheel tractor scraper, tractors, snow grooming machines, etc.

The vehicle 402 includes the vehicle body 406 and the implements 404(A) and 404(B). Each of the implements 404(A) and 404(B) are attached or connected to the vehicle body 406 via the corresponding lift frame 408(A) or 408(B). The implement 404(A) is, generally, disposed forward of the vehicle body 406 and supported by the lift frame 408(A) and the implement 404(B) is, generally, disposed at a rear of the vehicle body 406 and supported by the lift frame 408(B). In the current example, each of the implements 404(A) and 404(B) includes a corresponding cutting edge 410(A) and 410(B) that may contact the ground during operations of the vehicle 402 including sloping, digging, leveling, grading, ripping, etc. In the current example, the implements 404(A) and 404(B) are configured to be lifted up and down in conjunction with the motion of the corresponding lift frame 408(A) or 408(B).

Each of the lift frames 408(A) or 408(B) may pivot vertically about an axis (not shown) in a lateral direction (right and left direction from the front of the vehicle 402). In the current example, the lift frames 408(A) or 408(B) supports the corresponding implement 404(A) or 404(B) through a joint (such as a ball-and-socket joint), a pitching support link, and a bracing structure (not shown). However, the implement 404(A) or 404(B) may be supported by the corresponding lift frames 408(A) or 408(B) in other ways.

The sensor package system 400 installed or mounted on the vehicle 402 to assist with determine a height and slope angle of the implement POIs may include a position unit (such as a GNSS sensor) 412. The position unit 412 may be disposed on the top of the vehicle body 406 (for example, on top of a cab 414 associated with the vehicle body 406). The position unit 412 may include one or more antennas for receiving satellite signals and one or more receivers or other components for decoding the satellite signals and determining a global position of the position unit 412. In some cases, the satellite signals received by the position unit 412 may be in various formats or standards, such as GPS, GLONASS, Galileo, BeiDou as well as other satellite navigation standards. The position unit 412 may have a different arrangement on top of the vehicle body 406. For instance, the position unit 412 may be disposed on the center of the cab 414 as illustrated with respect to FIG. 2 below.

The sensor package system 400 installed or mounted on the vehicle 402 may also include an implement angle acquisition unit (such as an IMU sensor), such as implement angle acquisition units 416(A) and 416(B) disposed on each of the implements 404(A) or 404(B). Each of the implement angle acquisition units 416(A) and 416(B) may include one or more accelerometers, one or more gyroscopes, one or more magnetometers, and/or one or more pressure sensors, among others sensors. In one particular example, each the implement angle acquisition units 416(A) and 416(B) may include three accelerometers placed orthogonal to each other, three rate gyroscopes placed orthogonal to each other, three magnetometers placed orthogonal to each other, and a barometric pressure sensor. The placement of the implement angle acquisition units 416(A) and 416(B) on the corresponding implements 404(A) or 404(B) allows the implement angle acquisition units 416(A) and 416(B) to collect data related to the motion and angles of the corresponding implements 404(A) or 404(B).

The sensor package system 400 installed or mounted on the vehicle 402 may also include a vehicle body angle acquisition unit 418 disposed on the vehicle body 406. The vehicle body angle acquisition unit 418 may be mounted on the vehicle body 406 to determine the pitch, roll, and yaw angles of the vehicle body 406 independent of the implements 404(A) or 404(B) pitch, roll, and yaw angles. In some cases, the vehicle body angle acquisition unit 418 may also include one or more accelerometers, one or more gyroscopes, one or more magnetometers, and/or one or more pressure sensors, among others sensors. The placement of the vehicle body angle acquisition unit 418 on the vehicle body 406 allows the vehicle body angle acquisition unit 418 to collect data related to the motion and angles (pitch, roll, and yaw) of the vehicle body 406.

The control unit may be configured to calculate a global position of a implement POI (not shown) for each of the implements 404(A) or 404(B) based pitch, roll, and yaw of the implements 404(A) or 404(B), the pitch, roll, and yaw of the vehicle body 406, the global position of the position unit 412, and various geometric relations or offsets associated with the vehicle body 406, the lift frames 408(A) and 408(B), and implements 404(A) and 404(B), described in more detail below.

Figure 5:
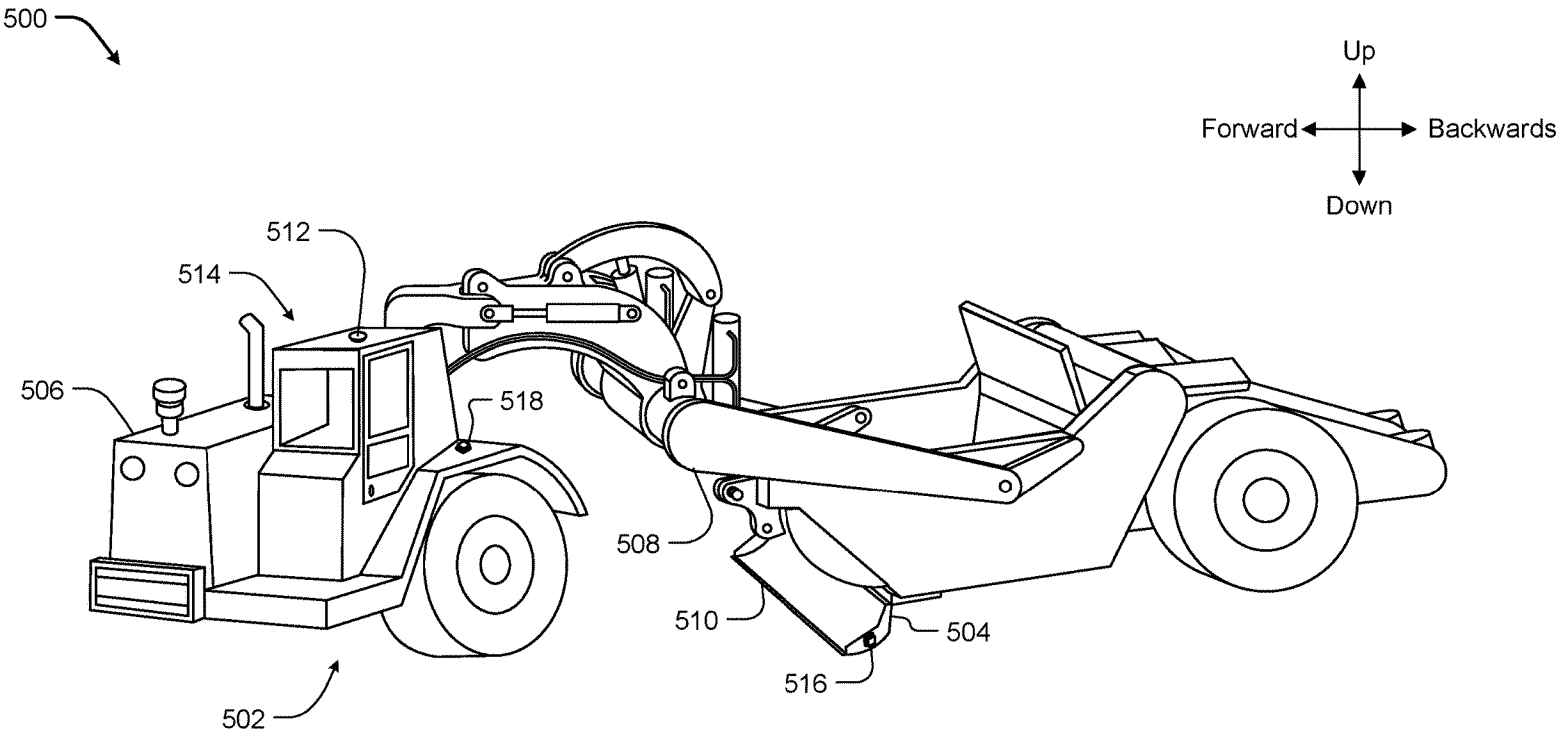
FIG. 5 is an orthogonal view of a sensor package system mounted on another vehicle for determining an implement point of interest according to some implementations.

FIG. 5 is an orthogonal view of a sensor package system 500 mounted on another vehicle 502 for determining an implement point of interest according to some implementations. In the current example, the vehicle 502 is a wheel tractor scraper and includes an implement 504. Implement 504 is a blade that may be utilized to level or perform finishing cuts associated with a series of cutting profiles. As in FIG. 4, in this example, the vehicle 504 does not include pitch cylinders for controlling the pitch of the implement 504 independent of the pitch of the lift frame 508.

The vehicle 502 includes the vehicle body 506 and the implement 504. The implement 504 is attached or connected to the vehicle body via a lift frame 508. The implement 504 is, generally, disposed toward the middle of the vehicle body 506 and supported by the lift frame 508. In the current example, the implement 504 includes a cutting edge 510 which contacts the ground during operations of the vehicle 502 including sloping, digging, leveling, grading, finishing, etc. The implement 504 is configured to be lifted up and down in conjunction with the motion of the lift frame 508.

The sensor package system 500 installed or mounted on the vehicle 502 may include a position unit (such as a GNSS sensor) 512. The position unit 512 may be disposed on the top of the vehicle body 506 (for example, on top of a cab 514 associated with the vehicle body 506). The position unit 512 may include one or more antennas for receiving satellite signals and one or more registered or other components for decoding the satellite signal and determining a global position of the position unit 512.

The sensor package system 500 installed or mounted on the vehicle 502 may also include an implement angle acquisition unit 516 disposed on the implement 504. The implement angle acquisition unit 516 may include one or more accelerometers, one or more gyroscopes, one or more magnetometers, and/or one or more pressure sensors, among others sensors. In the illustrated example, the implement angle acquisition unit 516 is shown as positioned at a side of the implement 504. However, in other examples, the implement angle acquisition unit 516 may be placed at other locations along the implement 504, such as at the back center. The placement of the implement angle acquisition unit 516 on the implement 504 allows the implement angle acquisition unit 516 to collect data related to the motion and angles of the implement 504.

The sensor package system 500 installed or mounted on the vehicle 502 may also include a vehicle body angle acquisition unit 518 disposed on the vehicle body 506. The vehicle body angle acquisition unit 518 may be mounted at any location on the vehicle body 506 (including the top of the cab 514) to determine the pitch, roll, and yaw angles of the vehicle body 506 independent of the implement 504 pitch, roll, and yaw angles. In some cases, the vehicle body angle acquisition unit 518 may also include one or more accelerometers, one or more gyroscopes, one or more magnetometers, and/or one or more pressure sensors, among others sensors.

A control unit (not shown) may be configured to calculate a global position of an implement POI (not shown) based pitch, roll, and yaw of the implement 504, the pitch, roll, and yaw of the vehicle body 506, the global position of the position unit 512, and various geometric relations or offsets associated with the vehicle body 506, the lift frame 508, and the implement 504, described in more detail below.

Figure 6:
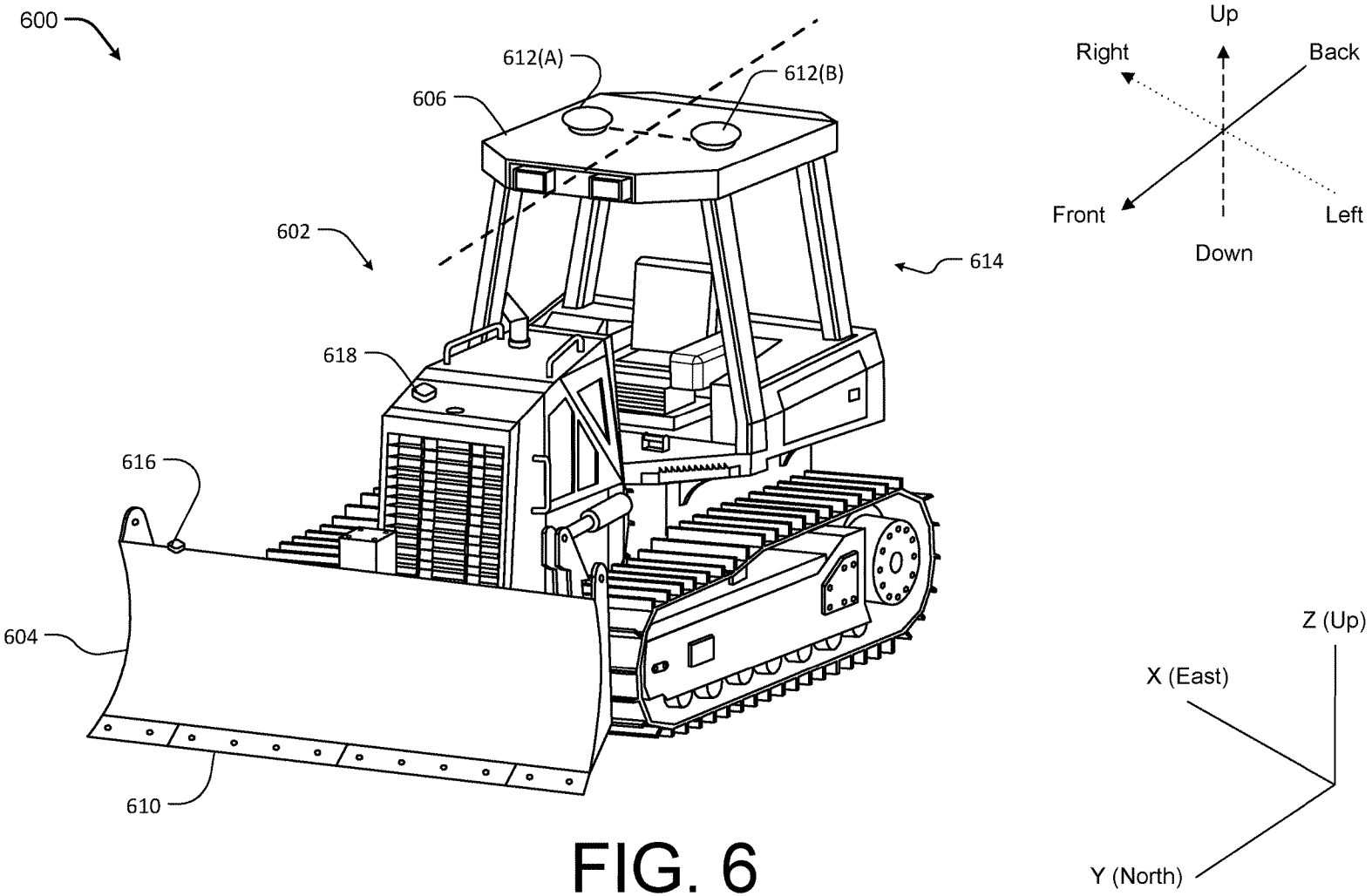
FIG. 6 is an orthogonal view of another sensor package system mounted on a vehicle including an implement without independent pitch control according to some implementations.

FIG. 6 is another orthogonal view of a sensor package system 600 mounted on a vehicle 602 including an implement 604 according to some implementations. In this example, the vehicle 602 does not include pitch cylinders for controlling the pitch of the implement 604 independent of the pitch of the lift frame. In the current example, the vehicle 602 is a bulldozer but it should be understood that the sensor package system 600 may be applied to any vehicle including an implement 604.

The vehicle 602 includes the vehicle body 606 and the implement 604. The implement 604 is attached or connected to the vehicle body 606 via a lift frame (not shown). The implement 604 is, generally, disposed forward of the vehicle body 606 and supported by the lift frame. The implement 604 includes a cutting edge 610 which contacts the ground during operations of the vehicle 602 including sloping, digging, leveling, grading, etc. The implement 604 is configured to be lifted up and down in conjunction with the motion of the lift frame.

The sensor package system 600 installed or mounted on the vehicle 602 may include a position unit 612(A) and a second position unit 612(B). The position unit 612(A) and the second position unit 612(B) may be disposed on the top of the vehicle body 606. For instance, in the illustrated example, first position unit 612(A) and the second position unit 612(B) are both disposed on top of a cab 614 associated with the vehicle body 606. Each of the position unit 612(A) and 612(B) may include one or more antennas for receiving satellite signals and one or more registered or other components for decoding the satellite signal and determining a global position associated with each of the position unit 612(A) and 612(B).

In the illustrated example, the first position unit 612(A) and the second position unit 612(B) are aligned along a lateral axis of the vehicle body 606 to provide positioning data and roll angles and yaw angles of the vehicle body 606. A known or fixed distance between the first position unit 612(A) and the second position unit 612(B) is measured during installation. Alternatively, the first position unit 612 (A) and the second position unit 612(B) may be aligned along a longitudinal axis of the vehicle body 606 to provide positioning data, pitch and yaw angles of the vehicle body 606. A known or fixed distance between the first position unit 612(A) and the second position unit 612(B) may be measured during installation.

By utilizing the first position unit 612(A) and the position unit 612(B) with a known or fixed distance between them, a control unit may differentiate the two global position coordinates measured by the position unit 612(A) and the second position unit 612(B) to determine the roll and yaw angles when aligned along the lateral axis as illustrated or the pitch and yaw angles when aligned along the longitudinal axis of the vehicle body 606, as well as the global position of the vehicle 602. In this implementation, the use of the second position unit 612(B) to assist in determining two of the three rational angles in lieu a single IMU sensor to allow for a more accurate measurement which in turn allows for more fine-tuned or precise control of the implement 604 during operation.

The sensor package system 600 installed or mounted on the vehicle 602 may also include a first angle acquisition unit 616 disposed on the implement 604. The first angle acquisition unit 616 may include one or more accelerometers, one or more gyroscopes, one or more magnetometers, and/or one or more pressure sensors, among others sensors. In one particular example, the first angle acquisition unit 616 may include three accelerometers placed orthogonal to each other, three rate gyroscopes placed orthogonal to each other, three magnetometers placed orthogonal to each other, and a barometric pressure sensor. The first angle acquisition unit 616 on the implement 604 allows the first angle acquisition unit 616 to collect data related to the motion and angles (pitch, roll, and yaw) of the implement 604.

The sensor package system 600 installed or mounted on the vehicle 602 may also include a second angle acquisition unit 618 disposed on the vehicle body 606. The second angle acquisition unit 618 may be mounted on the vehicle body 602 to determine the missing rational angle (e.g., the pitch of the vehicle body 602 in the illustrated example) that is not determined using the data collected by the first position unit 612(A) and the second position unit 612(B). In some cases, the second angle acquisition unit 618 may also include one or more accelerometers, one or more gyroscopes, one or more magnetometers, and/or one or more pressure sensors, among others sensors.

The angle acquisition unit 616 may be configured to send the pitch, roll, and yaw of the implement 604 to a control unit mounted within an engine compartment or cab compartment of the vehicle 602. Similarly, the second angle acquisition unit 618 and/or the vehicle body angle part may be configured to send either the pitch or roll angles of the vehicle body 606 to the control unit. The control unit may also receive global position data representative of the first position unit 612(A) and the second position unit 612(B) and determine the remaining two angles of the vehicle body 606 as well as the implement POI global position using a location of the global position of a position reference point (for instance, a position of the position unit 612(A), the second position unit 612(B), or a location between the two position unit 612(A) and 612(B)), the rotational angles of the vehicle body 606, a first known or fixed geometric offset (measured in the (X, Y, Z) dimensions) between the position reference point) and a reference position on the lift frame, and a second known or fixed geometric offset (measured in the (X, Y, Z) dimensions) between the lift frame reference point) and the implement POI.

Figure 7:
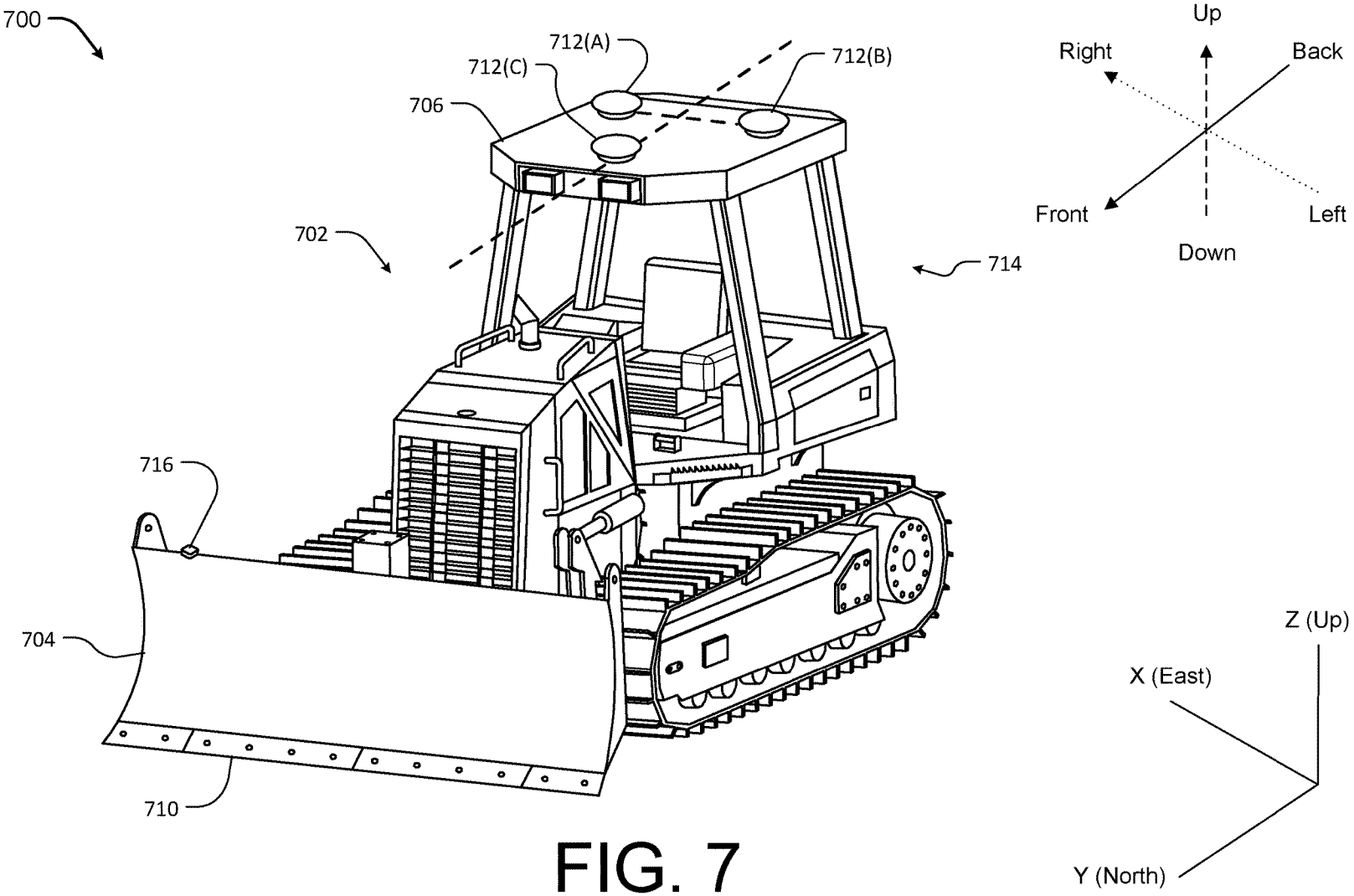
FIG. 7 is an orthogonal view of another sensor package system mounted on a vehicle including an implement without independent pitch control according to some implementations.

FIG. 7 is another orthogonal view of a sensor package system 700 mounted on a vehicle 702 including an implement 704 according to some implementations. In this example, the vehicle 702 does not include pitch cylinders for controlling the pitch of the implement 704 independent of the pitch of the lift frame. As in the examples above, the vehicle 702 is a bulldozer, but it should be understood that the sensor package system 700 may be applied to any vehicle including an implement 704.

The sensor package system 700 installed or mounted on the vehicle 702 may include a first position unit 712(A), a second position unit 712(B), and a third position unit 712(C). The first position unit 712(A), the second position unit 712(B), and the third position unit 712(C) may be disposed on the top of the vehicle body 706. In the illustrated example, the first position unit 712(A), the second position unit 712(B), and the third position unit 712(C) are disposed on top of a cab 714 associated with the vehicle body 706. Each of the first position unit 712(A), the second position unit 712(B), and the third position unit 712(C) may include one or more antennas for receiving satellite signals and one or more registered or other components for decoding the satellite signal and determining a global position associated with each of the first position unit 712(A), the second position unit 712(B), and the third position unit 712(C).

In the illustrated example, the first position unit 712(A) and the second position unit 712(B) are aligned a latitudinal axis of the vehicle body 706 and the third position unit 712(C) is aligned along the longitudinal axis of the vehicle body 706. The three position unit 712(A)-(C) may be utilized to determine positioning data and the rotational angles of the vehicle body 706. A known or fixed distance between the first position unit 712(A) and the second position unit 712(B), a known or fixed distance between the first position unit 712(A) and the third position unit 712(C), and a known or fixed distance between the second position unit 712(B) and the third position unit 712(C) may be measured during installation.

By utilizing three position unit 712(A), 712(B), and 712(C) with known or fixed distances between them, a control unit may differentiate the three global position coordinates measured by the first position unit 712(A), the second position unit 712(B), and the third position unit 712(C) to determine the global position of the vehicle body 706, in addition to the vehicle body pitch, roll, and yaw angles of the vehicle body 706. Thus, in the illustrated example, the angle acquisition unit on the vehicle body 706 may be foregone and the pitch, roll, and yaw angles of the vehicle body 706 may be determined as a more accurate measurement.

However, the sensor package system 700 installed or mounted on the vehicle 702 may still include an implement angle acquisition unit 716 disposed on the implement 704. As described above, the implement angle acquisition unit 716 may include one or more accelerometers, one or more gyroscopes, one or more magnetometers, and/or one or more pressure sensors, among others sensors. The placement of the implement angle acquisition unit 716 on the implement 704 allows the implement angle acquisition unit 716 to collect data related to the motion and angles (pitch, roll, and yaw) of the implement 704.

Figure 8:
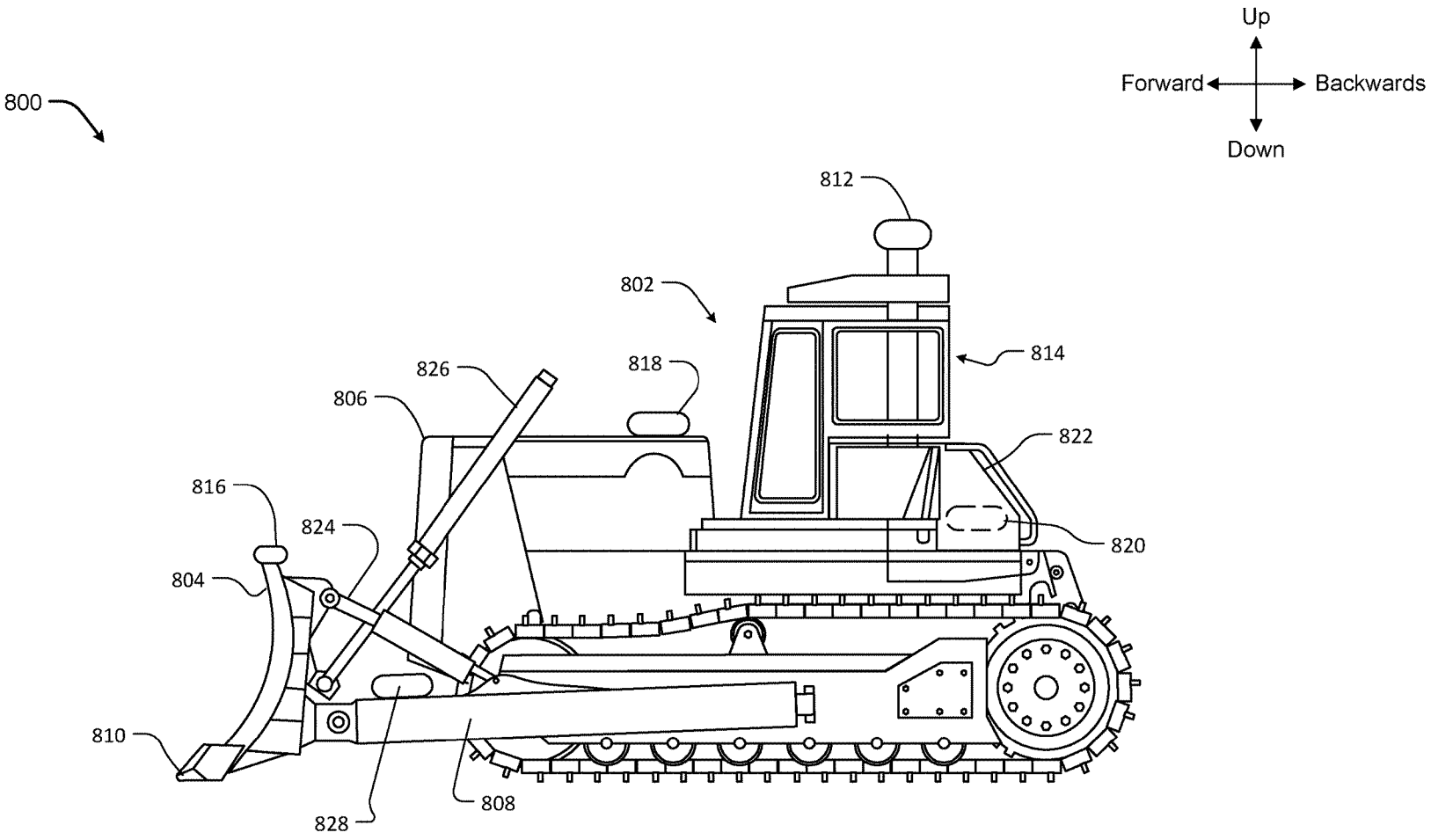
FIG. 8 is a side view of a sensor package system mounted on a vehicle including an implement having independent pitch control according to some implementations.

FIG. 8 is a side view of a sensor package system 800 mounted on a vehicle 802 including an implement 804 according to some implementations. In the illustrated example, the vehicle 802 includes the vehicle body 806 and the implement 804. The implement 804 is attached or connected to the vehicle body 806 via an implement support system. The implement 804 is, generally, disposed forwards of the vehicle body 806 and supported by the implement support system. The implement 804 includes a cutting edge 810 which contacts the ground during operations of the vehicle 802 including sloping, digging, leveling, grading, etc. In the current implementation, the implement support system includes pitch and tilt cylinders 824 for controlling the tilt and pitch of the implement 804 in addition to lift cylinders 826 for controlling lower and extending the implement 804. Thus, in this illustrated example, the implement 804 may pitch independent of a lift frame 808.

Similar to the system 400 of FIG. 4, the sensor package system 800 installed or mounted on the vehicle 802 may include a position unit 812. The position unit 812 may be disposed on the top of the vehicle body 806 (for example, on top of a cab 814 associated with the vehicle body 806). The position unit 812 may include one or more antennas for receiving satellite signals and one or more receivers or other components for decoding the satellite signal and determining a global position of the position unit 812. In some cases, the satellite signals received by the position unit 812 may be in various formats or standards, such as GPS, GLONASS, Galileo, BeiDou as well as other satellite navigation standards. The position unit 812 may have different arrangements on top of the vehicle body 806. For instance, the position unit 812 may be disposed on the center of the vehicle body 806.

The sensor package system 800 installed or mounted on the vehicle 802 may also include an implement angle acquisition unit 816 disposed on the implement 804. The implement angle acquisition unit 816 may include one or more accelerometers, one or more gyroscopes, one or more magnetometers, and/or one or more pressure sensors, among others sensors. The placement of the implement angle acquisition unit 816 on the implement 804 allows the implement angle acquisition unit 816 to collect data related to the motion and angles of the implement 804.

The sensor package system 800 installed or mounted on the vehicle 802 may also include a vehicle body angle acquisition unit 818 disposed on the vehicle body 806. The vehicle body angle acquisition unit 818 may be mounted on the vehicle body 802 to determine the pitch, roll, and yaw angles of the vehicle body 802 independent of the implement 804 pitch, roll, and yaw angles. In some cases, the vehicle body angle acquisition unit 818 may also include one or more accelerometers, one or more gyroscopes, one or more magnetometers, and/or one or more pressure sensors, among others sensors. The placement of the vehicle body angle acquisition unit 818 on the vehicle body 806 allows the vehicle body angle acquisition unit 818 to collect data related to the motion and angles (pitch, roll, and yaw) of the vehicle body 806.

In this example, the pitch, roll, and yaw of the implement 804 is known via the implement angle acquisition unit 816. Similarly, the pitch, roll, and yaw of the vehicle body 806 is known via the vehicle body angle acquisition unit 818. The global position of the vehicle body 806 is also known via the position 812. Since the implement 804 may pitch independent of the lift frame 808, a difference between the pitch angle of the implement 804 and the pitch of the lift frame 808 may vary during use. Thus, the system 800 includes a lift frame angle acquisition unit 828 positioned or mounted on the lift frame 808 to assist in determining the pitch angle of the of the lift frame 808. In some cases, the lift frame angle acquisition unit 828 may be a gyroscope. In other cases, the lift frame angle acquisition unit 828 may include additional gyroscopes, accelerometers, magnetometers, and/or pressure sensors to determine data associated with the yaw and roll angles of the lift frame 808 independent of the vehicle body roll and yaw angles.

Thus, a position recognizing system may be configured to calculate a global position of a implement POI (not shown) based on pitch, roll, and yaw of the implement 804, the pitch, roll, and yaw of the vehicle body 806, the pitch, roll, and yaw of the lift frame 808, the global position of the position unit 812, and various geometric relations or offsets associated with the vehicle body 806, the lift frame 808, and implement 804, described in more detail below with respect to FIG. 10.

In the current example a position unit 812, the implement angle acquisition unit 816, and the vehicle body angle acquisition unit 818 in addition to the lift frame angle acquisition unit 828 on the lift frame 808. However, in other examples, the lift frame angle acquisition unit 828 may be utilized in combination with the systems 400-700 described above with respect to FIGS. 4-7. Thus, in another example in which the implement 804 may pitch independent of the lift frame 808.

Figure 9:
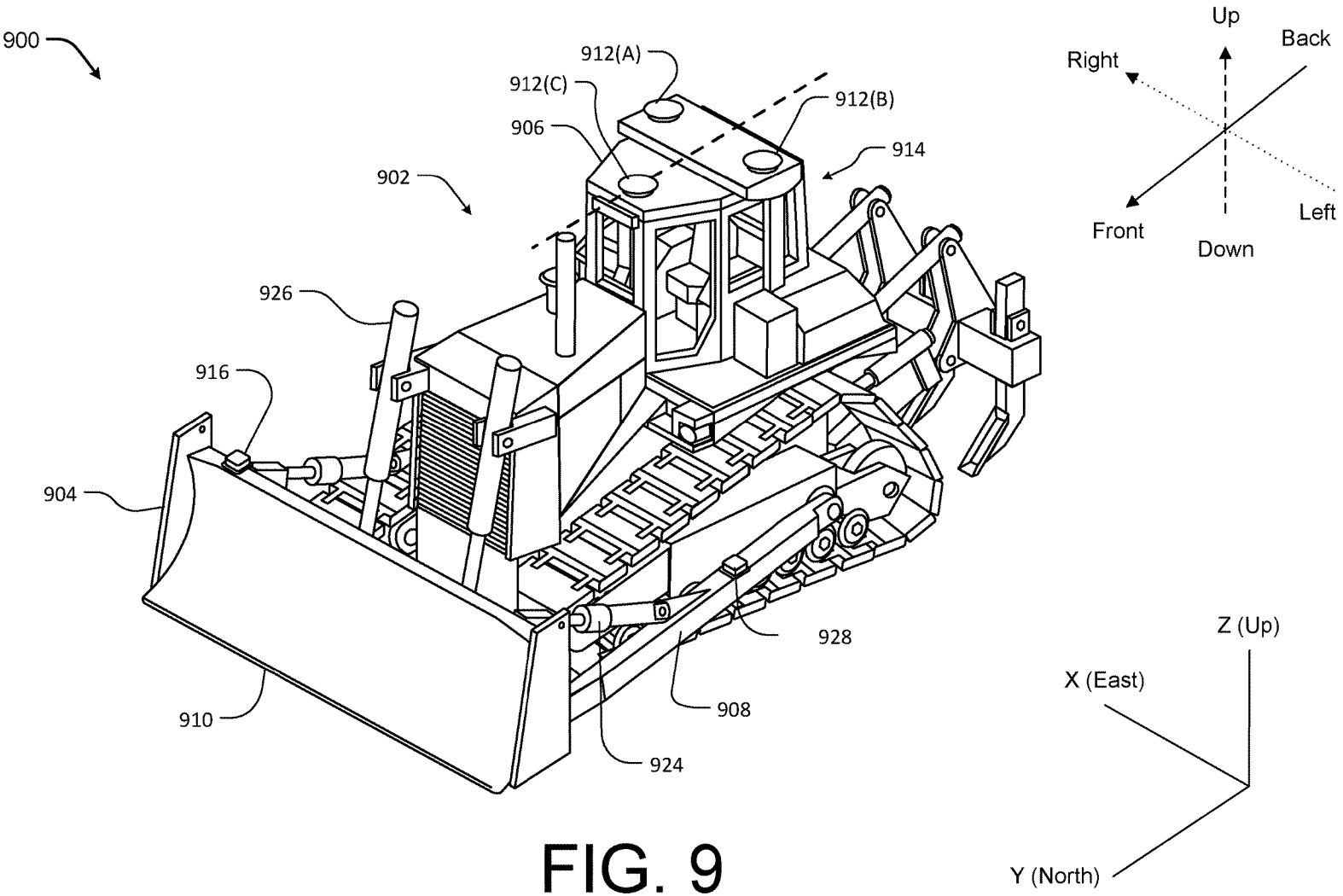
FIG. 9 is an orthogonal view of another sensor package system mounted on a vehicle including an implement having independent pitch control according to some implementations.

FIG. 9 illustrates yet another sensor package system 900 mounted on a vehicle 902 including an implement 904 in which the implement may pitch independent of the lift frame 908. In this example, the implement 904 includes a cutting edge 910 and is attached or connected to the vehicle body 906 via an implement support system. The implement support system includes a lift frame 908 for raising and lowering the implement 904, pitch and tilt cylinders 924 for controlling the pitch and tilt of the implement 904, and lift cylinders 926 for extending implement 904. Thus, similar to the example system 800 above, the implement 904 may pitch independent of the lift frame 908.

In the illustrated example, the sensor package system 900 installed or mounted on the vehicle 902 may include a first angle position unit 912(A), a second angle position unit 912(B), and a third angle position unit 912(C). The first angle position unit 912(A), the second angle position unit 912(B), and the third angle position unit 912(C) may be disposed on the top of a cab 714 associated with the vehicle body 906. In the current example, the first angle position unit 912(A) and the second angle position unit 912(B) are aligned along a latitudinal axis of the vehicle body 906 and the third angle position unit 912(C) is aligned along a longitudinal axis of the vehicle body 906 to provide positioning data and in some cases, the roll angle, yaw angle, and/or pitch angle of the vehicle body 906. A known or fixed distance between the first angle position unit 912(A) and the second angle position unit 912(B), the first angle position unit 912(A) and the third angle position unit 912(C), and the second angle position unit 912(B) and the third angle position unit 912(C) may be measured during installation.

By utilizing three angle position unit 912(A), 912(B), and 912(C) with known or fixed distances between them, the system 900 may differentiate the three global position coordinates measured by the first angle position unit 912(A), the second angle position unit 912(B), and the third angle position unit 912(C) to determine the pitch, roll, and yaw angles of the vehicle body 906. Thus, in the illustrated example, the vehicle body angle acquisition unit 818 of FIG. 8 on the vehicle body 906 may be foregone and the pitch, roll, and yaw angles of the vehicle body 906 may be determined more accurately.

The sensor package system 900 installed or mounted on the vehicle 902 does include an implement angle acquisition unit 916 disposed on the implement 904. The implement angle acquisition unit 916 may include one or more accelerometers, one or more gyroscopes, one or more magnetometers, and/or one or more pressure sensors, among others sensors. The placement of the implement angle acquisition unit 916 on the implement 904 allows the implement angle acquisition unit 916 to collect data related to the motion and angles of the implement 904.

In this example, the pitch, roll, and yaw of the implement 904 is known via the implement angle acquisition unit 916. Similarly, the pitch, roll, and yaw of the vehicle body 906 may be calculated using the data received by the three position units 912(A), 912(B), and 912(C) and the position of the vehicle body 906 may be determined using one or more of the position units 912(A)-(C). Since the implement 904 may pitch independent of the lift frame 908, a difference between the pitch angle of the implement 904 and the pitch of the lift frame 908 may vary during use. Thus, the system 900 includes a lift arm angle acquisition unit 928 positioned or mounted on the lift frame 908 to assist in determining the pitch angle of the of the lift frame 908. The position of the implement POI may be determined using the rotational angles of the lift frame 908, the rotational angles of the implement 904, the rotational angles of the vehicle body 906, and the position of one or more reference points on the vehicle body 906 and/or the lift frame 908, and known geometric offsets between the reference points and the implement POI.

Figure 10:
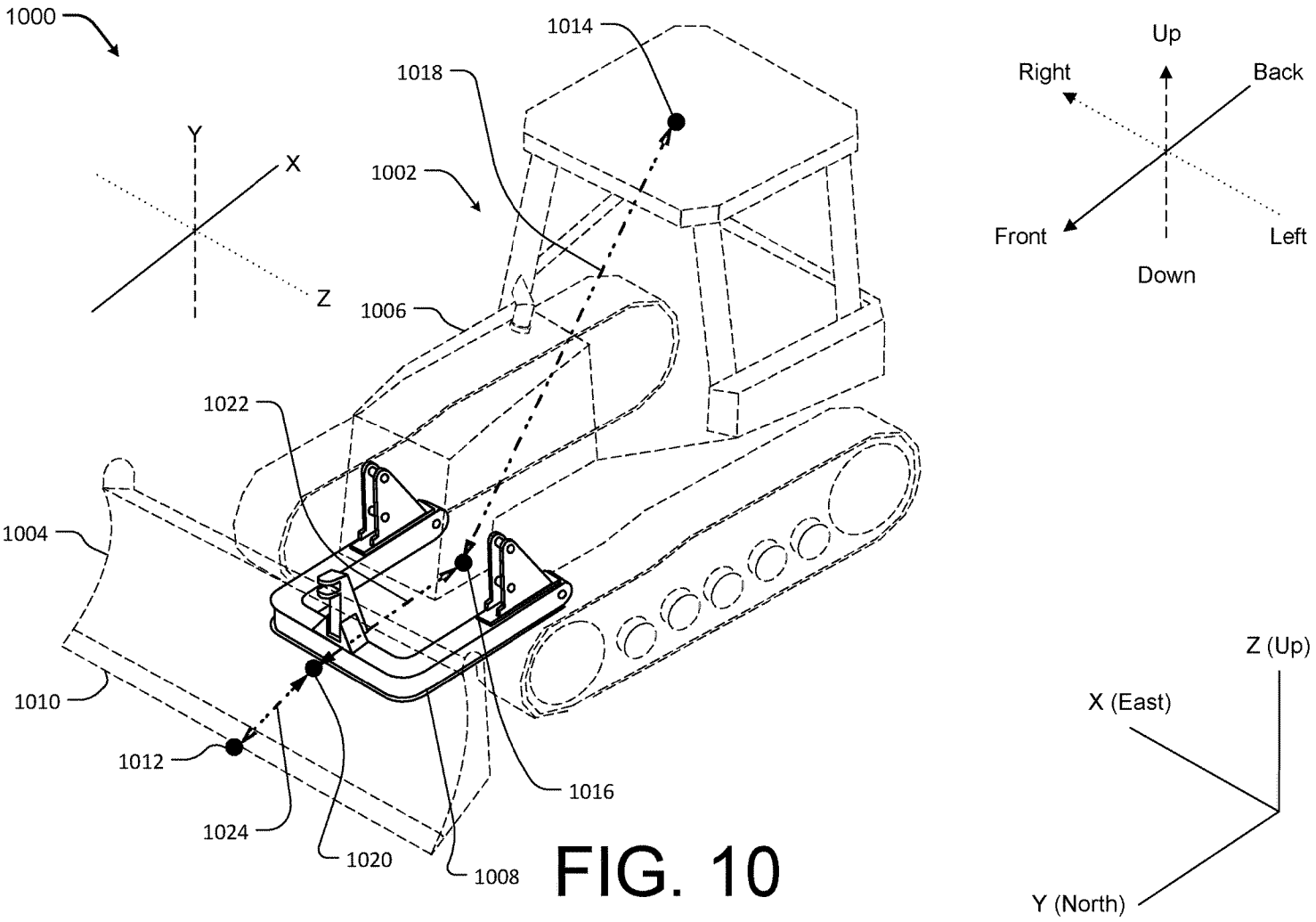
FIG. 10 is an orthogonal view of a vehicle to illustrate vehicle body reference points that may be utilized for calculating the points of interest and angles, positions, and slopes for controlling an implement of the vehicle during operation according to some implementations.

FIG. 10 is an orthogonal view of a vehicle 1002 to illustrate vehicle body reference points that may be utilized for calculating an implement point of interest 1012 for controlling the implement 1004 during operation according to some implementations. In some cases, to accurately control the vehicle 1002 and a implement 1004 during operations such as sloping, digging, leveling, grading, ripping, etc., an east, north, up (ENU) coordinates of the implement POI 1012 and the rotational angles (pitch, roll, and yaw) of the implement POI 1012 are determined based on the data collected by at least one of the sensor systems 400-900 of FIGS. 4-9 (not shown) installed on the vehicle 1002.

Unlike the global longitude, latitude, and altitude (LLA) coordinates received and determined by the GNSS sensors, the ENU coordinates are local coordinates that may be utilized to control the operations of the vehicle 1002. For example, the ENU frame may be used as a position reference in an X-Y plane that is tangential to ellipsoid surface of the Earth as determined by the World Geodetic System 1984 (WGS-84).

To determine an ENU coordinates and angles of the implement POI 1012, a control may assign the pitch, roll, and yaw angles determined via the angle acquisition unit (not shown) located on the implement 1004 as described above with respect to FIGS. 4-9. The control unit may also determine the ENU coordinates of the implement POI 1012 using various reference points associated with the vehicle 1002.

In one example, the control unit may receive vehicle body rotational angles (pitch, roll, and yaw) of the vehicle body 1006 and the LLA coordinates of a reference point 1014. For instance, as described above, the vehicle body rotational angles may be received or determined from data obtained by one or more angle acquisition units on the vehicle body 1006, a combination of angle acquisition units and position units on the vehicle body, or from multiple position units. Likewise, as described above, the LLA coordinates of the reference point 1014 may be received from one or more position units. For example, the reference point 1014 may be a center of one of the position units or a point between the position units. The control unit may then convert the LLA coordinates of the reference point 1014 to ENU coordinates of the reference point 1014 based at least in part on the vehicle body rotational angles (pitch, roll, and yaw) and the LLA coordinates of the reference point 1014.

Next, the control unit may first determine the ENU coordinates of a lift frame origin point (LFOP) 1016 associated with the lift frame 1008. As illustrated, the LFOP 1016 may be located at a central position between the two location at which the lift frame 1008 attaches to the vehicle body 1006. The control unit may determine the ENU coordinates of the LFOP 1016 by applying a coordinate inference model to the ENU coordinates of the reference point 1014, and a known geometric offset 1018 (e.g., one or more distances measured during installation). The control unit may assign the vehicle body rotational angles to the LFOP 1016 as the LFOP 1016 and the vehicle body 1006 are not configured to rotate in any dimension independently of each other.

In some cases, the geometric offsets may be calculated in three dimensional space. For instance, in the current example, the reference point 1014 and the LFOP 1016 are within the same plane (e.g., along the vehicle center line). However, in other examples, the reference point 1014 and/or the LFOP 1016 may be offset from the center line. Thus, the geometric offsets may be represented using X, Y, and Z dimensions, as illustrated.

The control unit may determine the ENU coordinates and angles of an implement origin point (TOP) 1020 associated with a location at which the implement 1004 attaches to the lift frame 1008. The control unit may assign the rotational angles of the TOP 1020 based on the angles determined using a lift frame angle acquisition unit, as discussed above. In other examples, the rotational angles may be assigned using the data collected by a vehicle body angle acquisition unit mounted on the vehicle body 1006 and/or an implement angle acquisition unit mounted on the implement 1004, such as when the implement 1004 does not pitch independently of the lift frame 1008. In another example, the roll and yaw angles may be assigned using the vehicle body 1006 rotational angles and the pitch angle may be obtained using a gyroscope mounted on the lift frame 1008.

The control unit may also determine the ENU coordinates of the IOP 1020 by applying a second coordinate inference model to the ENU coordinates of the LFOP 1016, the lift frame 1008 rotational angles, and a second known geometric offset 1022 (e.g., a distance measured during installation). In some cases, second coordinate inference model may differ from the first coordinate inference model, while in other cases, the third coordinate inference model may be the same as the first coordinate inference model.

The control unit may also determine the ENU coordinates and angles of an implement POI 1012. The control unit may determine the ENU coordinates of the implement POI 1012 by applying a third coordinate inference model to the ENU coordinates of the TOP 1022, and a third known geometric offset 1024 (e.g., one or more distances measured during installation). The control unit may also assign the implement rotation angles based on data measured by the implement angle acquisition unit mounted on the implement as described above.

In the current example, the implement POI 1012 is illustrated as a central position along the bottom of the implement 1004 to reduce the number of calculations during application of the coordinate inference models. However, the implement POI 1012 may be positioned at any point along the bottom of the implement 1004 which contacts the ground, such as at either bottom corner.

Once the position recognizing system determines the implement POI 1012, the control unit may compare the current position of the implement POI 1012 with a desired position indicated by a current cutting profile and to generate correction commands to adjust the implement POI 1012 when a difference of greater than a threshold amount is determined between the position of the implement POI 1012 and the desired position indicated in the current cutting profile.

FIGS. 11-16 are flow diagrams illustrating example processes associated with controlling an implement based on a cutting profile according to some implementations. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, encryption, deciphering, compressing, recording, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures, or environments.

Figure 11:
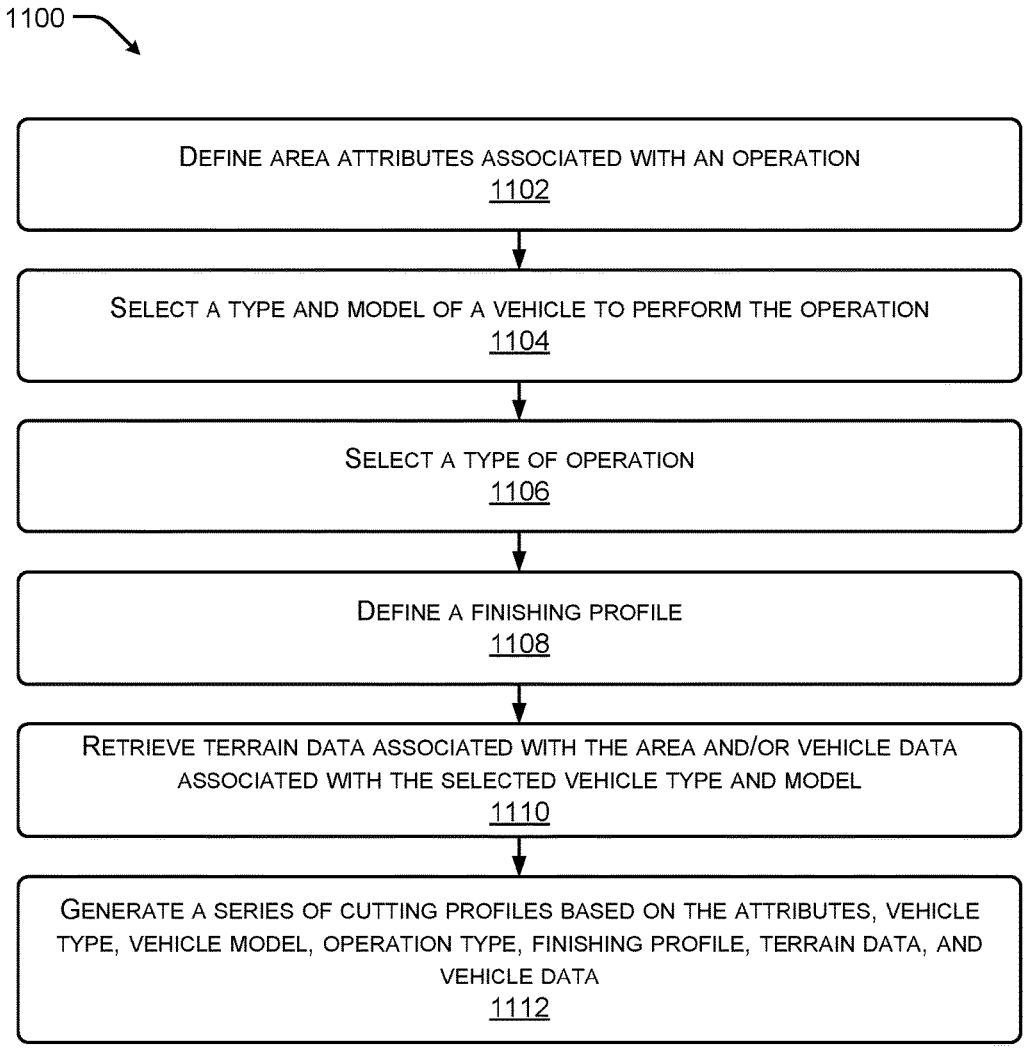
FIG. 11 is an example flow diagram showing an illustrative process for generating a navigation path and associated cutting profiles associated with a vehicle according to some implementations.

FIG. 11 is an example flow diagram showing an illustrative process 1100 for generating a navigation path and associated cutting profiles associated with a vehicle's according to some implementations. For example, an operator may cause an administrator system, such as the administrator system 108 of FIG. 1, to generate a navigation path and associated cutting profiles to accomplish a desired operation or job.

At 1102, the operator may define area attributes associated with an operation using the administrator system. For example, the operator may define a boundary associated with the operation, a type of operation, implement load thresholds, wheel/track slip rate thresholds, implement height and/or slope angle thresholds, vehicle velocity thresholds, among others. The operator may also define attributes such as fuel efficiency, vehicle wear and tear thresholds, implement wear and tear thresholds, expected completion times, desired working conditions, among others.

At 1104, the operator may select a type and model of a vehicle to perform the operation using the administrator system. For example, the type of vehicle may be a bulldozer, wheel scraper, motor grader (as discussed above), as well as other types of vehicles such as snow groomers. The operator may also select a model of the vehicle. For example, a larger vehicle may be desired for larger operations.

At 1106, the operator may select a type of operation using the administrator system. For example, the types of operations may include sloping, digging, leveling, grading, ripping, etc. in some cases, the types of operations may be a combination of operations and/or defined by the operator on a job by job or location by location basis.

At 1108, the operator may select a finishing profile using the administrator system. For example, the last of the cutting profiles may be a finishing profile (e.g., the end state of the surface of the terrain being transformed by the vehicle). In some cases, the finishing profile may be a flat horizontal surface (e.g., such as when building a road). In other cases, the finishing profile may be a slope (such as a ramp), a predefined depth (such as in a basement of a building), etc.

At 1110, the administrator system may retrieve terrain data associated with the area and/or vehicle data associated with the selected vehicle. For example, the administrator system may access one or more geologic survey databases or satellite mapping databases to retrieve elevation, height, slope, ground type, boundaries, obstacles (e.g., boulders, trees, etc.), among other types of information associated with the terrain being transformed.

At 1112, the administrator system may generate a navigation path and a series of cutting profiles based on the attributes, vehicle type, vehicle model, operation type, finishing profile, terrain data, and vehicle data. For example, the administrator system may determine an amount of load to place on the implement during each pass over a particular area of terrain and to generate multiple cutting profiles to achieve the finishing profile on the particular area without exceeding the amount of load per pass.

Figure 12:
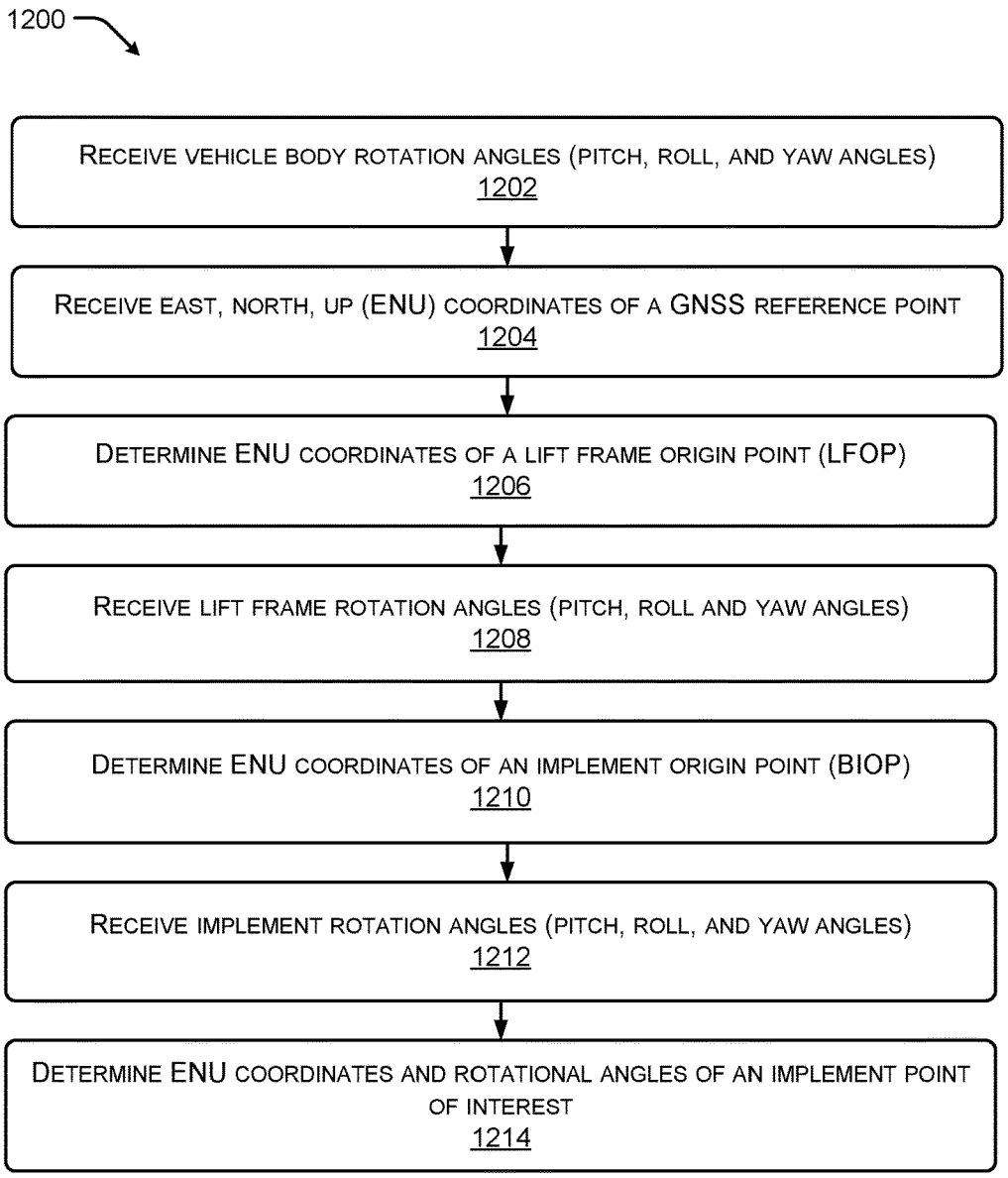
FIG. 12 is an example flow diagram showing an illustrative process for determining coordinates and angles of an implement point of interest according to some implementations.

FIG. 12 is an example flow diagram showing an illustrative process 1200 for determining coordinates of an implement point of interest according to some implementations. For instance, coordinates of the implement POI are determined by a control unit to adjust a position of the implement while the vehicle performs an operation based on the desired implement position defined within the current cutting profile.

At 1202, a control unit receives vehicle body rotation angles (pitch, roll, and yaw) of the vehicle body. For example, an angle acquisition unit (such as an IMU) mounted on the body of the vehicle may provide data usable by the control unit to determine the pitch, roll, and yaw angles associated with the vehicle body. In another example, an angle acquisition unit mounted on the body of the vehicle in conjunction with two or more position units mounted on the body of the vehicle may provide the data usable by the position recognizing system to determine the pitch, roll, and yaw angles. In yet another example, three or more position units mounted on the body of the vehicle may provide the data usable by the control unit to determine the pitch, roll, and yaw angles.

At 1204, the control unit may receive ENU coordinates of a reference point. In some cases, the position recognizing system may receive LLA coordinates associated with one or more position units and convert the LLA coordinates into ENU coordinates. The control unit may also determine the ENU coordinates of the reference point based at least in part on the ENU coordinates of the position units. For example, the system may include a single position unit. In this example, the ENU coordinates of the position unit may also be the ENU coordinates of the reference point (e.g., the position unit is the reference point). In other examples, the reference point may be a location between the one or more position unit and may be determined based at least in part on the ENU coordinates of each of the position unit and one or more known distances.

At 1206, the control unit determines ENU coordinates of a lift frame origin point (LFOP) based at least in part on the ENU coordinates of the reference point and at least one geometric offset between the LFOP and the reference point. For example, the LFOP may be located at a central position between the two fixed location at which the lift frame attaches to the vehicle body. The control unit may determine the ENU coordinates of the LFOP by applying a coordinate inference model to the ENU coordinates of the reference point and known geometric offsets or a distance between the reference point and the LFOP.

At 1208, the control unit may receive rotational angles of a lift frame supporting the implement. For example, a gyroscope mounted on the lift frame may provide data usable by the position recognizing system for determining the pitch angle of the lift frame. In another example, an angle acquisition unit (such as an IMU) may be mounted on the lift frame in lieu of the gyroscope to provide all three rotational angles of the lift frame (e.g., the pitch, roll, and yaw angles).

At 1210, the control unit determines ENU coordinates of an implement origin point (TOP) based at least in part on the ENU coordinates of the LFOP, at least one geometric offset between the LFOP and the IOP, and the pitch, roll, and yaw angles of the lift frame. For example, the IOP may be at a location that the implement attaches to the lift frame. The control unit may determine the ENU coordinates of the IOP by applying a coordinate inference model the ENU coordinates of the LFOP, a geometric offset between the LFOP and the IOP, and the pitch, roll, and yaw angles.

At 1212, the control unit may receive rotation angles (pitch, roll, and yaw) of the implement. For example, an angel acquisition unit may be mounted on the implement to obtain data usable by the position recognizing system for determining the rotation angles of the implement.

At 1214, the control unit determines ENU coordinates of implement POI based at least in part on the ENU coordinates of the TOP and at least one geometric offset between the implement POI and the IOP. The implement POI may be a central position along the bottom of the implement, as described above with respect to FIG. 8. Alternatively, the implement POI may be any position at any point along the bottom of the implement that contacts the terrain, such as at either bottom corner.

Figure 13:
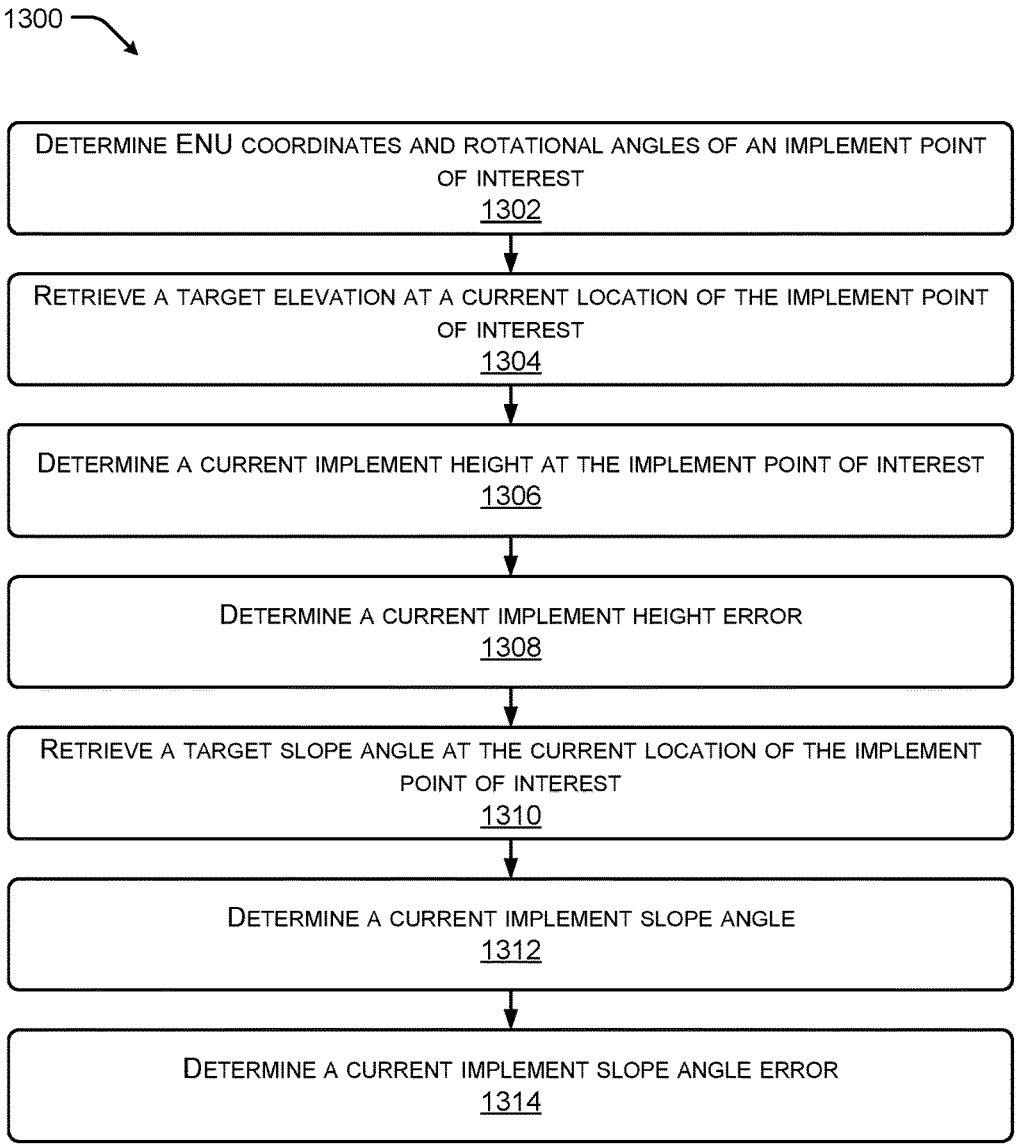
FIG. 13 is an example flow diagram showing an illustrative process determining height error and slope angle error of an implement at a given time according to some implementations.

FIG. 13 is an example flow diagram showing an illustrative process 1300 determining height error and slope angle error of an implement at a given time according to some implementations. For example, a control unit may be configured to periodically, regularly, continuously, or at predefined intervals determine a height error and slope angle error associated with the implement and to adjust a position of the implement based on the height error, slope angle error, and the desired height and slope of the implement according to a current cutting profile.

At 1302, the control unit may determine the ENU coordinates and rotational angles of an implement POI, as described above with respect to FIG. 12. For example, the implement POI and rotational angles may be determined based at least in part on data collected by various angle acquisition units and position units mounted on the vehicle, as well as various known distances or offsets between one or more reference points on the vehicle.

At 1304, the control unit may retrieve a target elevation at a current location of the implement POI. For example, the target elevation may be defined by a current cutting profile. In other cases, the control unit may have access to one or more terrain databases (such as via a wireless communication interface).

At 1306, the control unit may determine a current implement height at the implement POI. For example, based at least in part on the ENU coordinates of the implement POI and data known about a current height of the terrain, the control unit may determine the current implement height.

At 1308, the control unit may determine a current implement height error. For example, by utilizing the target elevation at the current location and the current implement height, the control unit may determine the current implement height error or the distance between the elevation at the current location and the current implement height.

At 1310, the control unit may retrieve a target slope angle at a current location of the implement POI. For example, the target slope angle may be defined by a current cutting profile.

At 1312, the control unit may determine a current implement slope angle at the implement POI. For example, based at least in part on the rotational angles of the implement POI (determined, for instance, via an IMU on the implement) and data known about a current slope angle of the terrain, the control unit may determine the current implement slope angle.

At 1314, the control unit may determine a current implement slope angle error. For example, by utilizing the target slope angle at the current location and the current implement slope angle, the control unit may determine the current implement slope angle error of the degree of offset between the get slope angle at the current location and the current implement slope angle.

Figure 14:
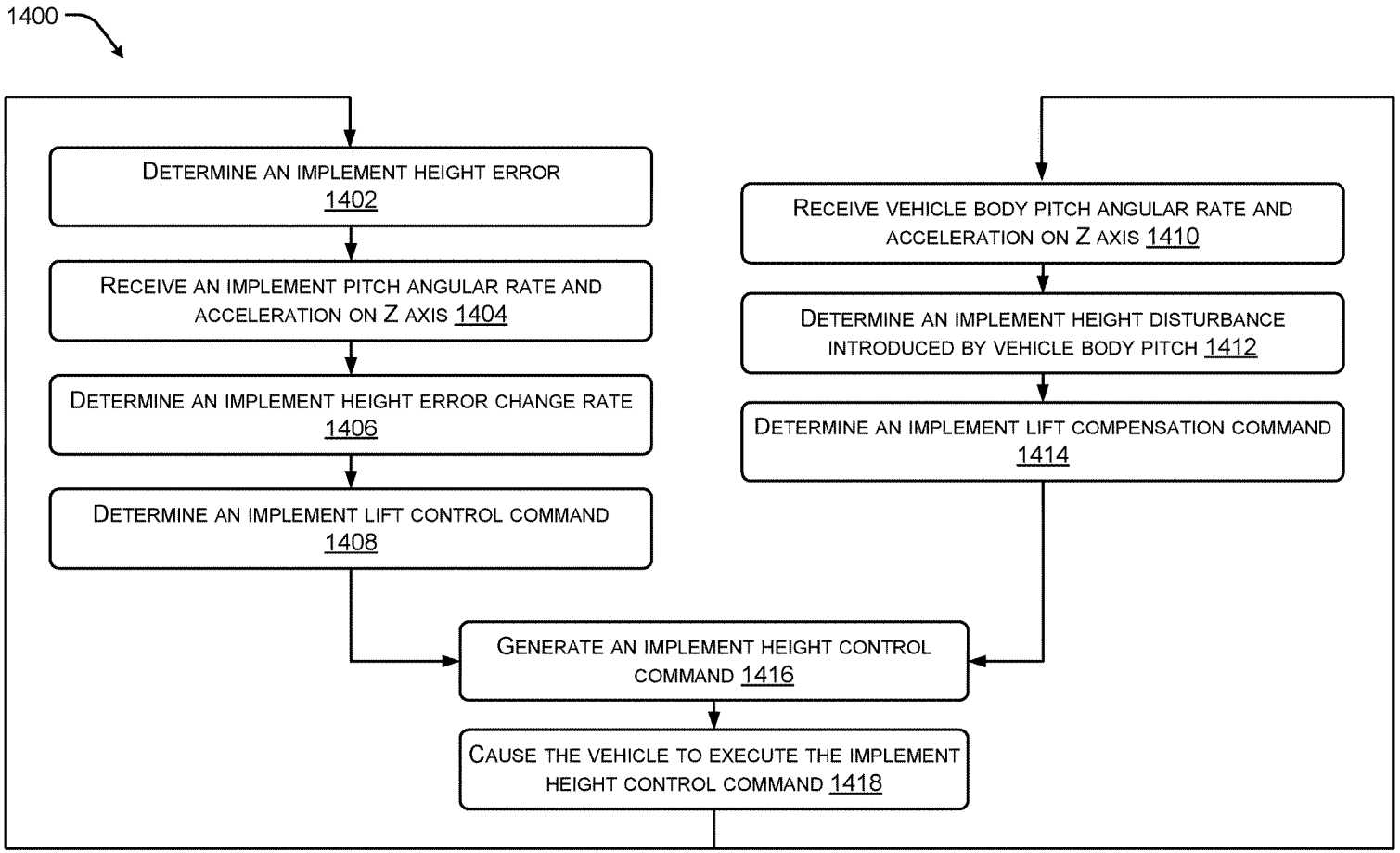
FIG. 14 is an example flow diagram showing an illustrative process for determining an implement height control command according to some implementations.

FIG. 14 is an example flow diagram showing an illustrative process 1400 for determining an implement height control command according to some implementations. For example, the height control command may be calculated in substantially real time or near real time to cause the implement to adjust to a targeted height with respect to the terrain being transformed. In the current example, the height control command may be issued to one or more components, systems, or devices for controlling the height of the implement with respect to the vehicle.

At 1402, a control unit may determine an implement height error. In other cases, the control unit may receive the implement height error from another device or component associated with the vehicle. In general, the implement height error may be a distance between a current position of the implement POI and the targeted height or position with respect to the terrain according to a current cutting profile.

At 1404, the control unit may receive an implement pitch angular rate and acceleration on a Z axis of the implement. For instance, the rate of pitching of the implement in the up and down direction (e.g., along the Z axis) may affect the position of the implement POI as the vehicle continues to perform the operation and should be compensated for by the control unit when determining the implement height control command.

At 1406, the control unit may determine an implement height error change rate. The rate at which the height error is changing may affect a value and/or direction associated with the height control command. For example, if the implement is pitching forward or toward the ground, the height error change rate may be negative and may be lowering the implement with respect to the targeted elevation. Thus, the height control command may cause the vehicle to raise the implement even if the implement is currently positioned above the target elevation.

At 1408, the control unit may determine an implement lift control command. For example, the implement lift control command may be part of the height control command. The implement lift control command may include a value and direction to adjust the height of the implement based on the movement of the implement with respect to the terrain.

At substantially the same time that the implement lift control command is determined by the control unit, the control unit may also determine an implement lift control compensation command as described with respect to 1410-1414 below. At 1410, the control unit may receive an vehicle body pitch angular rate and acceleration on a Z axis of the vehicle body. For instance, the rate of pitching of the vehicle body in the up and down direction (e.g., along the Z axis) may affect the position of the implement POI as the vehicle continues to perform the operation and should be compensated for by the control unit when determining the implement height control command.

At 1412, the control unit may determine an implement height disturbance introduced by the vehicle body pitch. For example, if the vehicle is pitching forward or toward the ground, the vehicle may introduce an implement height disturbance by causing the implement to move towards the ground in an unanticipated manner. Thus, the height control command may cause the vehicle to raise the implement even if the implement is currently positioned above the target elevation to compensate for the pitching of the vehicle body.

At 1414, the control unit may determine an implement lift compensation command. For example, the implement lift compensation command may be part of the height control command together with the implement lift control command. The implement lift compensation command may include a value and direction to adjust the height of the implement based on the movement of the vehicle with respect to the terrain.

At 1416, the control unit may generate the implement height control command. For example, the control unit may combine the value and direction of the implement lift control command and the implement lift compensation command to generate the implement height control command.

At 1418, the control unit may cause the vehicle to execute the implement height control command. For example, the control unit may cause a lift frame to adjust the height of the implement using a hydraulic, electric, or mechanical system.

Figure 15:
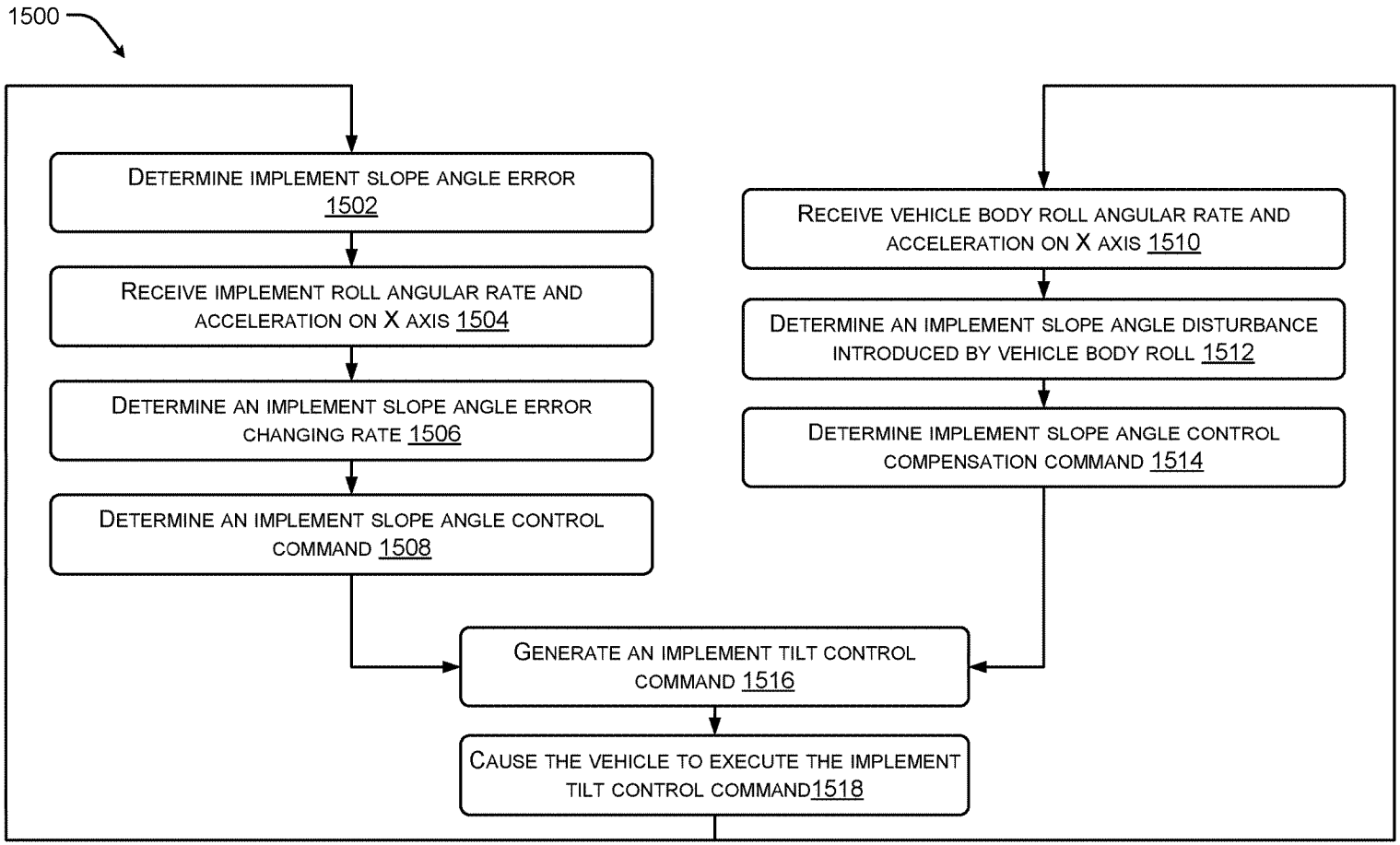
FIG. 15 is an example flow diagram showing an illustrative process for determining an implement slope angle control command according to some implementations.

FIG. 15 is an example flow diagram showing an illustrative process 1500 for determining an implement tilt control command according to some implementations. For example, the tilt control command may be calculated in substantially real time or near real time to cause the implement to adjust to a targeted angle with respect to the terrain being transformed. In the current example, the tilt control command may be issued to one or more components, systems, or devices for controlling the tilt and/or angle of the implement with respect to the vehicle.

At 1502, a control unit may determine an implement slope angle error. In other cases, the control unit may receive the implement slope angle error from another device or component associated with the vehicle. In general, the implement slope angle error may be a number of degrees of difference between a current slope angle of the implement and the targeted slope angle with respect to the terrain according to a current cutting profile.

At 1504, the control unit may receive an implement roll angular rate and acceleration on an X axis of the implement. For instance, the rate of tilting of the implement in the left or right direction (e.g., along the X axis) may affect the slope angle of the implement as the vehicle continues to perform the operation and should be compensated for by the control unit when determining the implement slope angle control command.

At 1506, the control unit may determine an implement slope angle error change rate. The rate at which the slope angle error is changing may affect a value and/or direction associated with the tilt control command. For example, if the implement is tilting to the left, the slope angle error change rate may be to the right.

At 1508, the control unit may determine an implement slope angle control command. For example, the implement slope angle control command may be part of the tilt control command. The implement slope angle control command may include a value and direction to adjust the slope angle of the implement based on the movement of the implement with respect to the terrain.

At substantially the same time that the implement slope angle control command is determined by the control unit, the control unit may also determine an implement slope angle control compensation command as described with respect to 1510-1514 below. At 1510, the control unit may receive an vehicle body roll angular rate and acceleration on an X axis of the vehicle body. For instance, the rate of tilting of the vehicle body in the left and right direction (e.g., along the X axis) may affect the slope angle of the implement as the vehicle continues to perform the operation and should be compensated for by the control unit when determining the implement tilt control command.

At 1512, the control unit may determine an implement slope angle disturbance introduced by the vehicle body roll. For example, if the vehicle is rolling to the left or right, the vehicle may introduce an implement slope angle disturbance by causing the implement to move in an unanticipated manner. Thus, the tilt command may cause the vehicle to tilt the implement in a manner to compensate for the rolling of the vehicle body.

At 1514, the control unit may determine an implement slope angle compensation command. For example, the implement slope angle compensation command may be part of the tilt command together with the implement slope angle control command. The implement slope angle compensation command may include a value and direction to adjust the slope angle of the implement based on the movement of the vehicle with respect to the terrain.

At 1516, the control unit may generate the implement tilt control command. For example, the control unit may combine the value and direction of the implement slope angle control command and the implement slope angle compensation command to generate the implement tilt control command.

At 1518, the control unit may cause the vehicle to execute the implement tilt control command. For example, the control unit may cause one or more tilt cylinders to adjust the position of the implement using a hydraulic, electric, or mechanical system.

Figure 16:
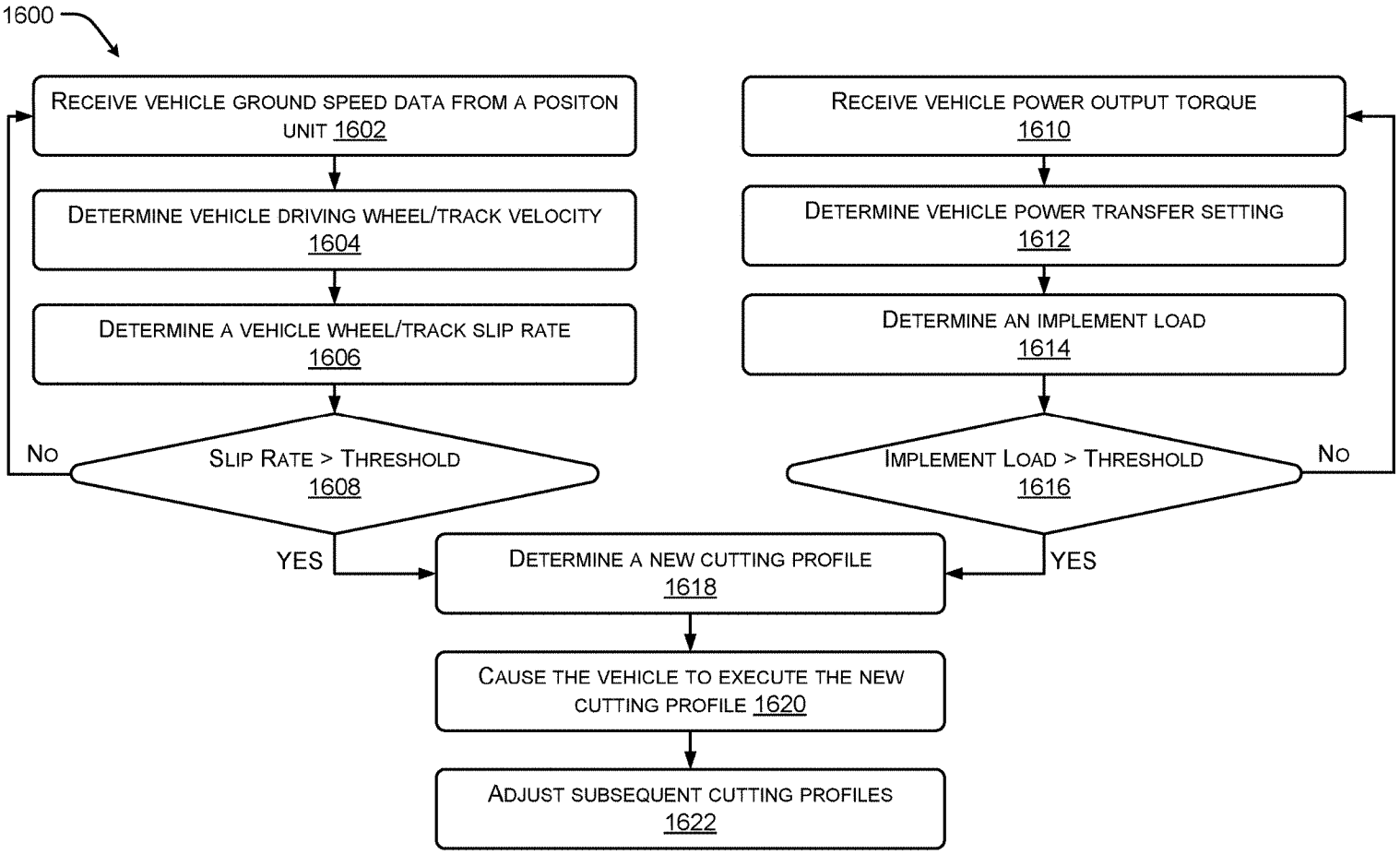
FIG. 16 is an example flow diagram showing an illustrative process for adjusting cutting profiles according to some implementations.

FIG. 16 is an example flow diagram showing an illustrative process 1600 for adjusting cutting profiles according to some implementations. In some cases, during an operation, a control unit of a vehicle may determine that the series of cutting profiles received from an administrator system may need to be adjusted. For instance, if the terrain is softer or harder than expected or the wear and tear on the vehicle treads is greater than expected, a threshold load on the implement may be greater than desirable or result in an inefficient use of the vehicle. In some cases, if the load due to a particular cutting profile causes the load to become too large the vehicle may even become stuck.

At 1602, the control unit may receive vehicle ground speed data from a position unit mounted on the vehicle. For example, as discussed above, the control unit may estimate or approximate a ground speed of the vehicle based on position data received from the position unit. Alternatively, the control unit may receive the vehicle's ground speed data from a sensor associated with a wheel or track of the vehicle. In some particular implementations, the control unit may receive the ground speed data from both the position units and the sensor associated with the wheel or track.

At 1604, the control unit determines a vehicle drive wheel/track velocity. For example, the speed or velocity of the wheel/track may not be the same as the ground speed of the vehicle (e.g., the wheel is turning at one speed and the vehicle is moving at another). In some cases, a wheel or track sensor may be associated with or coupled to the wheel/track or a drive motor associated with the wheel or track to measure and/or collect data associated with the drive wheel/track velocity.

At 1606, the control unit may determine a vehicle wheel/track slip rate using the ground speed and the wheel/track velocity, the control unit may determine the vehicle wheel/track slip rate. For example, a difference between the wheel/track slip rate and the ground speed may be used to determine the wheel/track slip rate.

At 1608, the control unit determines if the slip rate is greater than a threshold. For instance, if the slip rate is greater than a threshold, it may be an indication that the load on the implement is too large and/or the cut defined by the cutting profile is too deep given the terrain conditions and that the cutting profiles should be adjusted. If the slip rate is less than the threshold, the process 1600 may return to 1602 and the control unit may again determine the slip rate. Alternatively, if the slip rate is greater than the threshold, the process 1600 may proceed to 1618 described in more detail below.

At 1610, the control unit may receive vehicle power output torque. For example, a sensor may be associated with the drive motors, power source, or wheel/track system to measure and/or collect data associated with the vehicle power output torque.

At 1612, the control unit may determine a vehicle power transfer setting. For example, the control unit may determine the setting based on the navigation path or current cutting profile settings received from the administrator system.

At 1614, the control unit may determine an implement load based at least in part on the vehicle power output torque and the vehicle power transfer settings. For example, the control unit may determine an amount of power being output compared with the vehicle power output torque to determine the implement load.

At 1616, the control unit determines if the implement load is greater than a threshold. For instance, if the implement load is greater than a threshold, it may be an indication that the cutting profiles should be adjusted (e.g., to prevent the vehicle from becoming stuck). If the implement load is less than the threshold, the process 1600 may return to 1610 and the control unit may again determine the implement load. Alternatively, if the implement load is greater than the threshold, the process 1600 may proceed to 1618 described in more detail below.

At 1618, the control unit may determine a new cutting profile to replace the current cutting profile. For example, the control unit may reduce the angle or height of the current cut being performed by the vehicle to reduce the implement load and the slip rate.

At 1620, the control unit may cause the vehicle to execute the new cutting profile. For instance, the control unit may cause the lift frame or control cylinders of the implement to adjust the slope angle and/or height of the implement to reduce the cut according to the new cutting profile. In one example, increasing the height of the implement may reduce the overall load on the implement and allow the vehicle to continue the operation.

At 1622, the control unit may adjust subsequent cutting profiles. For instance, if the new cutting profile replaced the current cutting profile and the new cutting profile differs from the current cutting profile then following the completion of the new cut, the subsequent cutting profiles will not match the terrain. Therefore, each of the subsequent cutting profiles may be adjusted to accommodate the changes resulting from the generation of the new cutting profile.

Figure 17:
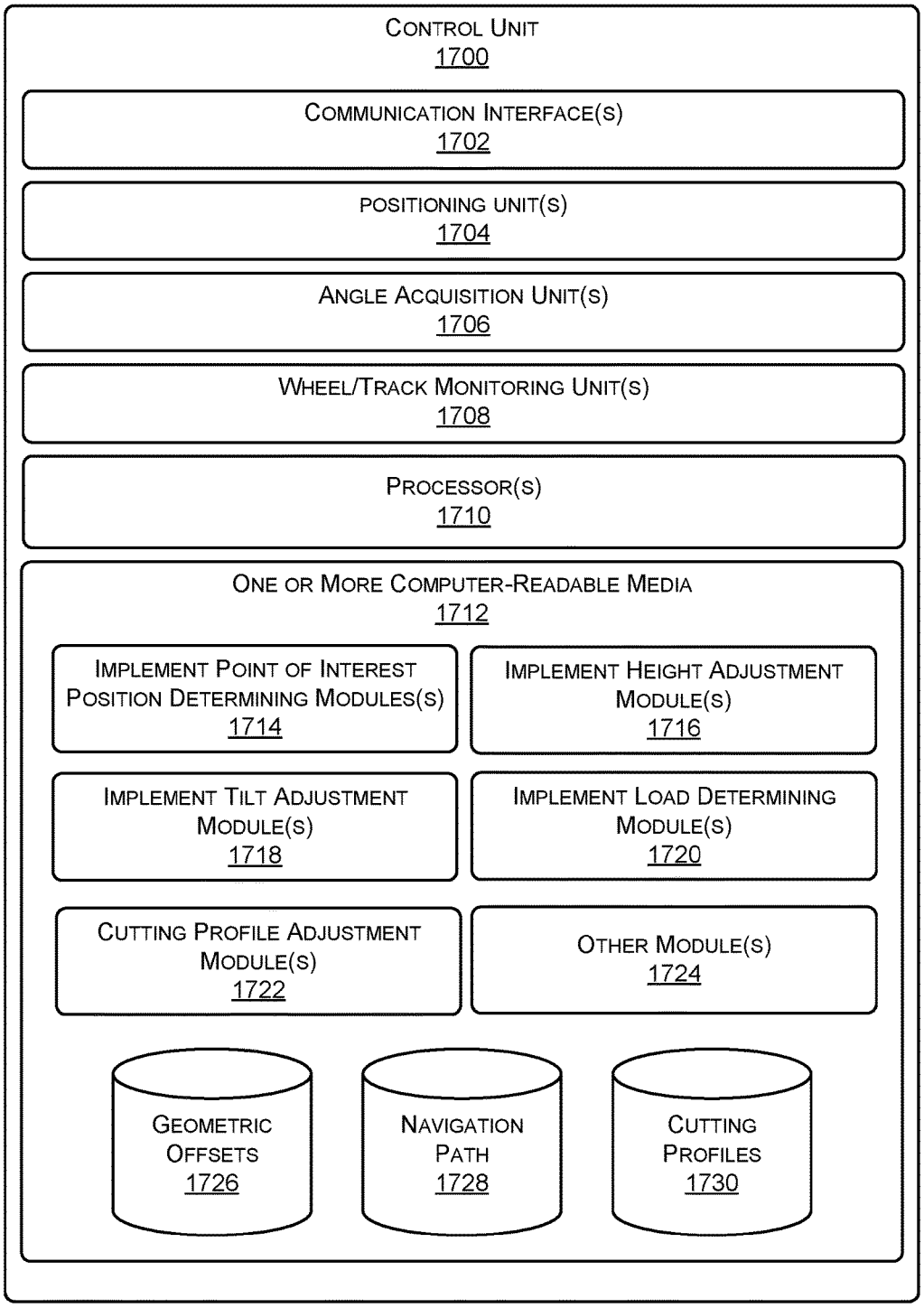
FIG. 17 illustrates example components of one or more servers associated with a control unit mounted on a vehicle according to some implementations.

FIG. 17 illustrates example components of one or more servers associated with a control unit 1700 mounted on a vehicle according to some implementations. In the illustrated example, the control unit 1700 may include one or more communication interfaces 1702, one or more positioning units 1704, and one or more angle acquisition units 1706 for collecting data usable for autonomous control of a vehicle, and one or more wheel/track monitoring units 1708 for monitoring a velocity of the wheel or track of the vehicle.

The communication interfaces 1702 may support both wired and wireless connection to various networks, such as cellular networks, radio networks (e.g., radio-frequency identification RFID), WiFi networks, short-range or near-field networks (e.g., Bluetooth®), infrared signals, local area networks, wide area networks, the Internet, and so forth. For example, the communication interfaces 1702 may allow the control unit 1700 to receive data, such as a navigation path or cutting profiles, from an administrator system or other remote control system.

The positioning units 1704 may include one or more sensor package combinations including GNSS sensors. In some cases, the positioning units 1704 may be disposed on the top of the vehicle body and include one or more antennas for receiving satellite signals and one or more receivers or other components for decoding the satellite signals and determining a global position of the positioning units 1704. In some cases, the satellite signals received by a GNSS sensor may be in various formats or standards, such as GPS, GLONASS, Galileo, BeiDou as well as other satellite navigation standards.

In some cases, the angle acquisition units 1706 may include one or more accelerometers, one or more gyroscopes, one or more magnetometers, and/or one or more pressure sensors, among others sensors. In one particular example, the angle acquisition units 1706 may include an IMU sensor or package. For instance, an IMU sensor or package may include three accelerometers placed orthogonally to each other, three rate gyroscopes placed orthogonally to each other, three magnetometers placed orthogonally to each other, and a barometric pressure sensor. In general, the angle acquisition units 1706 are configured to collect data associated with the movement and acceleration of the vehicle during operation.

The wheel/track monitoring units 1708 may include a left monitoring unit and a right monitoring unit. The left monitoring unit may be coupled between the left drive motor and the left propulsion device to monitor an actual power transfer, direction, and/or velocity of the left side of the vehicle. Similarly, the right monitoring unit may be coupled between the right drive motor and the right device to monitor an actual power transfer, direction, and/or velocity of the right side of the vehicle.

The control unit 1700 may also include processing resources, as represented by processors 1710, and computer-readable storage media 1712. The computer-readable storage media 1712 may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device.

Several modules such as instruction, data stores, and so forth may be stored within the computer-readable media 1712 and configured to execute on the processors 1710. For example, an implement POI position determining module 1714, an implement height adjustment module 1716, an implement tilt adjustment module 1718, an implement load determining module 1720, a cutting profile adjustment module 1722, as well as other modules 1724. In some implementations, the computer-readable media 1712 may store data, such as measured geometric offsets 1726, one or more navigation paths 1728, and cutting profiles 1730.

The implement POI position determining module 1714 may be configured to determine the rotational angles and position of the implement POI using various data collected by sensors mounted on the implement and the vehicle body. For example, the implement POI position determining module 1714 may utilize position data collected from position units, rotational angle data collected by angle acquisition units, as well as known geometric offsets in three dimensional spaced for reference points selected during installation of the sensor package system.

The implement height adjustment module 1716 may be configured to determine a height error between a height indicated by a current cutting profile and the height of the implement POI at a given position on a navigation path. For example, the height error may be a difference between an implement height at the POI and an implement height indicated by the current cutting profile. In some cases, when the height error is above a threshold (e.g., either too high or too low), the implement height adjustment module 1716 may determine an implement height control command to cause an implement height control mechanism (such as a lift arm) to adjust the height of the implement.

The implement tilt adjustment module 1718 may be configured to determine a slope angle error between a slope angle indicated by the current cutting profile and the slope angle of the implement at the given position on the navigation path. For example, the slope angle error may be a number of degrees of difference between an implement slope angle and an implement slope angle indicated by the current cutting profile. In some cases, when the slope angle error is above a threshold (e.g., the implement is tilted too far to the left or right compared to the slope angle in the cutting profile), the implement tilt adjustment module 1718 may determine an implement tilt control command to cause an implement tilt control mechanism (such as a hydraulic cylinder) to adjust the implement tilt adjustment module 1718 of the implement.

The implement load determining module 1720 may be configured to determine an implement load based in part on a wheel/track slip rate and/or vehicle power torque output. For example, a slip rate greater than a threshold amount is an indication that the load on the implement is too great for the vehicle and the cutting angle and/or height should be adjusted. In some cases, if the load is greater than a threshold amount (e.g., a slip rate threshold and/or a load threshold), then the implement load determining module 1720 may cause the cutting profile adjustment module 1722 to adjust the cutting profiles and/or the navigation path.

The cutting profile adjustment module 1722, may be configured to adjust a course, number of passes, depth/height of each cut, angle of each cut defined within the navigation path and/or cutting angle based on one or more parameters received from the administrator system, data collected by the various sensors and units, and/or information received from the implement height adjustment module 1716, the implement tilt adjustment module 1718, and/or the implement load determining module 1720. For example, if the implement height adjustment module 1716 issued an implement height control command or the implement tilt adjustment module 1718 issued an implement tilt control command to adjust the implement position with respect to the terrain then at least for some period of time the implement was out of position or in a position that deviated from the cutting profile. In these cases, the cutting profile adjustment module 1722 may adjust the subsequent cutting profiles to compensate for the height error or slope angle error detected by the implement height adjustment module 1716 or the implement tilt adjustment module 1718. In another example, if the implement load determining module 1720 determines the implement load is greater than a threshold, the current cutting profile may be adjusted to improve performance and each subsequent cutting profile may need to be adjusted to compensate for the changes in the current cutting profile as well as the condition detected by the implement load determining module 1720.

Figure 18:
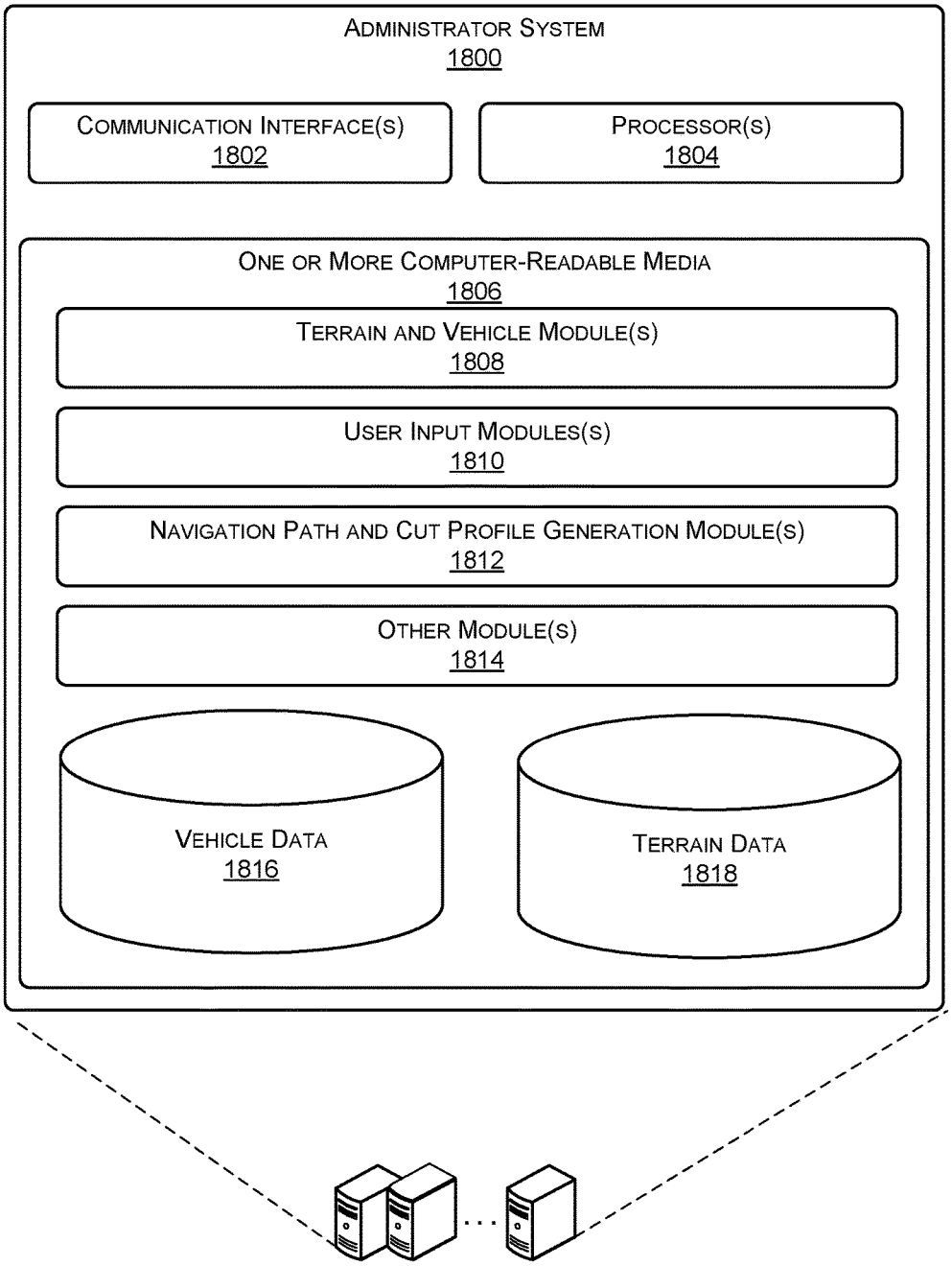
FIG. 18 illustrates example components of one or more servers associated with an administrator system according to some implementations.

FIG. 18 illustrates example components of one or more servers associated with an administrator system 1800 according to some implementations. The administrator system 1800 may be in communication with a control unit installed on a vehicle. In some cases, the administrator system 1800 may allow an operator remote from the vehicle to generate the navigation paths and cutting profiles to allow the vehicle to operate autonomously.

In the illustrated example, the administrator system 1800 includes communication interfaces 1802 that may support both wired and wireless connection to various networks, such as cellular networks, radio networks (e.g., radio-frequency identification RFID), WiFi networks, short-range or near-field networks (e.g., Bluetooth®), infrared signals, local area networks, wide area networks, the Internet, and so forth. For example, the communication interfaces 1802 may exchange data, such as a navigation path or cutting profiles, with the control unit or with a vehicle itself.

The administrator system 1800 may also include processing resources, as represented by processors 1804, and computer-readable storage media 1806. The computer-readable storage media 1806 may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device.

Several modules such as instruction, data stores, and so forth may be stored within the computer-readable media 1806 and configured to execute on the processors 1804. For example, a terrain and vehicle data module 1808, a user input module 1810, a navigation path and cutting profile generation module 1812, as well as other modules 1814. In some implementations, the computer-readable media 1808 may store data, such as vehicle data 1816 and terrain data 1818. The vehicle data 1816 may include information known about the vehicle, such as power output range, driving speed range, working tool or implement capacity, vehicle dimensions, vehicle weight, ground pressure, range of steering radius, maintenance history, operation or task logs, location, current assignments, last repair visit, stored health, status, or operational data, among others. The terrain data 1818 may include information known about the terrain or location the vehicle is currently transforming. For example, the terrain data 1818 may include geological surveys and maps, ground type, height and elevation data, flora and fauna associated with the terrain, any improvements or obstacles associated with the terrain, current task being performed on the terrain (e.g., gravel production, mining, logging, etc.), vehicle list assigned to the terrain, boundaries, among others.

The terrain and vehicle module 1808 may cause the administrator system 1800 to establish a communication channel with the vehicle or the remote database to retrieve the vehicle data 1816 and the terrain data 1818. For instance, the terrain and vehicle module 1808 may send diagnostic test instructions to the control unit on the vehicle to engage the navigation controls and collect data associated with the functionally of the vehicle and the current terrain.

The user input module 1810 may allow the operator to provide inputs into the creation of the navigation path or the cutting profiles. For example, the user input module 1810 may present the operator with selectable options to define or draw the navigation path, to input the navigation parameters (e.g., width of the navigation path), select a type of navigation, type of activity or operation to be performed (e.g., in the case of a bulldozer, grading, leveling, sloping, etc.), operation preferences (e.g., time limits for the task, fuel usage limits, wear and tear limits, implement load limits, etc.), among others. In some cases, the user input module 1810 may allow the operator to select or input various information known about the vehicle or about the terrain and useful for generating the navigation path and the cutting profiles.

The navigation path and cutting profile generation module 1812 is configured to generate the navigation path and the cut profiles based at least in part on the user inputs, the vehicle data 1816 and the terrain data 1818. For example, the navigation path and cutting profile generation module 1812 may modify a navigation path defined or outlined by the operator to increase a turning radius to, thereby, reduce the potential for decoupling a track from the wheel. In another example, the navigation path and cutting profile generation module 1812 may generate a series of cut profiles to achieve a desired finishing profile on the surface of the terrain.

In some examples, the navigation path and cut profile generation module 1812 may generate a series of navigation paths that allow the vehicle to make several passes over the same terrain to allow for multiple cuts based on multiple cut profiles to achieve the finishing profile. For example, the vehicle may make several cuts based on multiple cut profiles as described above with respect to FIG. 2.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A method comprising:

under control of one or more processors configured with executable instructions, receiving a navigation path and a cutting profile for a vehicle having an implement from a remote system via a wireless communication interface of a vehicle, the navigation path indicating at least one trajectory of the vehicle over a terrain;

determining a height associated with an implement point of interest;

determining an implement height error associated with the implement point of interest based at least in part on a height indicated by the cutting profile and the height associated with the implement point of interest;

determining an implement height error change rate;

receive a pitch angular rate and a pitch angular acceleration of an implement along a Z axis of the vehicle, the Z axis corresponding to an up direction with respect to the vehicle; and determining an implement lift control command based at least in part on the implement height error, the implement pitch angular rate, the pitch angular acceleration along the Z axis, and the implement height error change rate; and adjusting a height of the implement in response to determining the implement lift control command.

2. The method as recited in claim 1, further comprising:

receive a second pitch angular rate and a second pitch angular acceleration of a vehicle body along the Z axis of the vehicle;

determine an implement height disturbance introduced by the second vehicle body pitch angular rate and the second pitch angular acceleration; and determining an implement lift compensation command based at least in part on the implement height disturbance, the implement lift compensation command to cause the vehicle to adjust the height of the implement to compensate for disturbances from a body of the vehicle.

3. The method as recited in claim 2, further comprising:

generating an implement height control command to adjust the height of the implement based at least in part on the implement lift control command and the implement lift compensation command.

4. The method as recited in claim 3, further comprising:

causing the vehicle to execute the implement height control command.

5. The method as recited in claim 1, further comprising:

determining a slope angle associated with the implement;

determining an implement slope angle error associated with the implement based at least in part on a slope angle indicated by the cutting profile and the slope angle associated with the implement;

determining an implement slope angle error change rate;

receive a roll angular rate and acceleration of the implement along a X axis of the vehicle; and determining an implement slope angle control command based at least in part on the implement slope angle error, the implement roll angular rate and acceleration on the X axis, and the implement slope angle error change rate, the implement slope angle control command to cause the vehicle to adjust a tilt of the implement.

6. The method as recited in claim 1, further comprising:

receiving data associated with a global position of the vehicle from a positioning unit;

determining a ground speed associated with the vehicle based at least in part on the data associated with the global position;

receiving data associated with a velocity of a propulsion device;

determining a slip rate associated with the propulsion device based at least in part on the ground speed and the velocity of a propulsion device;

determining that the slip rate is greater than a slip rate threshold; and adjusting at least one parameter associated with the cutting profile in response to determining that the slip rate is greater than the slip rate threshold.

7. The method as recited in claim 1, further comprising:

receiving data associated with a power output torque of the vehicle;

determining a vehicle power transfer setting associated with the vehicle;

determining an implement load based at least in part on the power output torque and the vehicle power transfer setting;

determining that the implement load is greater than a load threshold; and adjusting at least one parameter associated with the cutting profile in response to determining that the implement load is greater than the load threshold.

8. The method as recited in claim 1, wherein the height associated with the implement point of interest is determined based at least in part using a position of a reference point with respect to the vehicle, the reference point associated with the position unit, rotational angles of the vehicle, and at least one known geometric offset between the reference point and the implement point of interest.

9. A method comprising:

under control of one or more processors configured with executable instructions, receiving a navigation path and a cutting profile for a vehicle having an implement from a remote system via a wireless communication interface of a vehicle;

determining a slope angle associated with an implement;

determining an implement slope angle error associated with the implement based at least in part on a slope angle indicated by the cutting profile and the slope angle associated with the implement;

determining an implement slope angle error change rate;

receiving a roll angular rate and a roll angular acceleration of the implement along a X axis of the vehicle, the X axis corresponding to a direction from a left side of the vehicle to a right side of the vehicle; and determining an implement slope angle control command based at least in part on the implement slope angle error, the roll angular rate, the roll angular acceleration of the implement along the X axis, and the implement slope angle error change rate; and adjusting a tilt of the implement in response to determining the implement slope angle control command.

10. The method as recited in claim 9, further comprising receiving a second roll angular rate and a second roll angular acceleration of the vehicle body along the X axis of the vehicle;

determine an implement slope angle disturbance introduced by the vehicle roll angular rate and the second roll angular acceleration; and determining an implement lift compensation command based at least in part on the implement slope angle disturbance, the implement slope angle compensation command to cause the vehicle to adjust the tilt of the implement.

11. The method as recited in claim 10, further comprising generating an implement tilt control command to adjust the tilt of the implement based at least in part on the implement slope angle control command and the implement slope angle compensation command.

12. The method as recited in claim 11, further comprising causing the vehicle to execute the implement height control command.

13. The method as recited in claim 9, further comprising determining a height associated with a point of interest of the implement;

determining an implement height error associated with the point of interest based at least in part on a height indicated by the cutting profile and the height associated with the point of interest;

determining an implement height error change rate;

receive a pitch angular rate and a pitch angular acceleration of the implement along a Z axis of the vehicle, the Z axis corresponding to an up direction with respect to the vehicle; and determining an implement lift control command based at least in part on the implement height error, the implement pitch angular rate, the pitch angular acceleration along the Z axis, and the implement height error change rate, the implement lift control command to cause the vehicle to adjust a height of the implement.

14. The method as recited in claim 9, further comprising receiving data associated with a global position of the vehicle from a positioning unit;

determining a ground speed associated with the vehicle based at least in part on the data associated with the global position;

receiving data associated with a velocity of a propulsion device;

determining a slip rate associated with the propulsion device based at least in part on the ground speed and the slip rate;

determining that the slip rate is greater than a slip rate threshold; and adjusting at least one parameter associated with the cutting profile in response to determining that the slip rate is greater than the slip rate threshold.

15. The method as recited in claim 9, further comprising receiving data associated with a power output torque of the vehicle;

determining a vehicle power transfer setting associated with the vehicle;

determining an implement load based at least in part on the power output torque and the vehicle power transfer setting;

determining that the implement load is greater than a load threshold; and adjusting at least one parameter associated with the cutting profile in response to determining that the implement load is greater than the load threshold.

16. A method comprising:

under control of one or more processors configured with executable instructions, receiving a navigation path and cutting profile for a vehicle having an implement from a remote system via a wireless communication interface;

receiving data associated with a global position of a vehicle from a positioning unit;

determining a ground speed associated with the vehicle based at least in part on the data associated with the global position;

receiving data associated with a velocity of a propulsion device;

determining a slip rate associated with the propulsion device based at least in part on the ground speed and the slip rate;

determining that the slip rate is greater than a slip rate threshold;

adjusting at least one parameter associated with the cutting profile in response to determining that the slip rate is greater than the slip rate threshold; and altering a position of the implement in response to adjusting the at least one parameter associated with the cutting profile.

17. The method as recited in claim 16, further comprising receiving data associated with a power output torque of the vehicle;

determining a vehicle power transfer setting associated with the vehicle;

determining an implement load based at least in part on the power output torque and the vehicle power transfer setting;

determining that the implement load is greater than a load threshold; and wherein the adjusting at least one parameter associated with the cutting profile is in response to determining that the implement load is greater than the load threshold.

18. The method as recited in claim 16, further comprising adjusting at least one parameter associated with a second cutting profile in response to adjusting the at least one parameter associated with the first cutting profile, the second cutting profile to be performed by the vehicle subsequent to the first cutting profile.

19. The method as recited in claim 16, further comprising:

causing the vehicle to execute the cutting profile after the at least one parameter has been adjusted.

20. The method as recited in claim 16, further comprising:

determining a first position of the vehicle at a first time;

determining a second position of the vehicle at a second time, the second time subsequent to the first time; and wherein determining the ground speed is based at least in part on the first position and the second position.

* * * * *